US011530592B2

(12) United States Patent
Perschke

(10) Patent No.: US 11,530,592 B2
(45) Date of Patent: Dec. 20, 2022

(54) WELLHEAD LUBRICATOR AND METHODS OF OPERATING SAME

(71) Applicant: Heshka Oil, Conroe, TX (US)

(72) Inventor: Malcolm Perschke, Conroe, TX (US)

(73) Assignee: Heshka Oil, Conroe, TX (US)

( * ) Notice: Subject to any disclaimer, the term of this patent is extended or adjusted under 35 U.S.C. 154(b) by 220 days.

(21) Appl. No.: 16/932,449

(22) Filed: Jul. 17, 2020

(65) Prior Publication Data

US 2022/0018206 A1 Jan. 20, 2022

(51) Int. Cl.
*E21B 33/068* (2006.01)
*E21B 19/086* (2006.01)

(52) U.S. Cl.
CPC ..... *E21B 33/068* (2013.01); *E21B 19/086* (2013.01)

(58) Field of Classification Search
CPC ..... E21B 33/068; E21B 19/086
See application file for complete search history.

(56) References Cited

U.S. PATENT DOCUMENTS

| | | | | |
|---|---|---|---|---|
| 334,690 | A | 1/1886 | Craik | |
| 5,875,851 | A | 3/1999 | Vick, Jr. et al. | |
| 6,199,628 | B1 | 3/2001 | Beck et al. | |
| 6,719,059 | B2 | 4/2004 | Dezen et al. | |
| 7,051,810 | B2 | 5/2006 | Clemens et al. | |
| 7,121,344 | B2 | 10/2006 | Fenton et al. | |
| 8,028,752 | B2 | 10/2011 | Richards | |
| 8,555,986 | B2 | 10/2013 | Clemens et al. | |
| 10,082,005 | B2 | 9/2018 | Salomonsen et al. | |
| 10,087,693 | B2 | 10/2018 | Bye | |
| 2009/0194291 | A1 | 8/2009 | Fesi et al. | |
| 2012/0024521 | A1 | 2/2012 | Villa | |
| 2016/0258232 | A1* | 9/2016 | Harper | E21B 19/086 |
| 2018/0080291 | A1* | 3/2018 | Sipos | E21B 19/086 |

OTHER PUBLICATIONS

"Snubbing Operations" https://www.coursehero.com/file/56096173/Snubbingpdf/, by Wildwell Control.

* cited by examiner

*Primary Examiner* — Giovanna Wright
(74) *Attorney, Agent, or Firm* — Nixon & Vanderhye P.C.

(57) ABSTRACT

In one of its example aspects the technology disclosed herein concerns a wellhead lubricator. In an example embodiment and mode the wellhead lubricator comprises a yoke housing; a first clamp; a second clamp; and, an extensible actuator. The yoke housing comprises a first end configured for connection to a barrel housing and a second end configured for connection to a wellhead. The yoke housing defines a yoke cavity through which a barrel rod extends along an axis of the yoke cavity. The first clamp is situated in the yoke cavity and is configured for selective engagement with the barrel rod. The second clamp is also situated in the yoke cavity and is configured for selective engagement with the barrel rod. The extensible actuator is connected to at least one of the first clamp and the second clamp. The extensible actuator, the first clamp, and the second clamp are configured to be operated in coordinated manner to provide translation of the barrel rod along the axis of the yoke cavity.

25 Claims, 14 Drawing Sheets

WELLHEAD LUBRICATOR AND METHODS OF OPERATING SAME

TECHNICAL FIELD

The technology relates to wellhead lubricators.

BACKGROUND

Inserting tools through wellheads and oilfield Christmas trees has been practiced for decades and is important for certain phases of well drilling, well completion, and well servicing. The process of inserting the downhole tools is generally accomplished using apparatus commonly referred to as a "lubricator". A lubricator comprises one or more tubulars that form a sealed chamber around a downhole tool. The lubricator is usually mounted atop a Blowout Preventer (BOP), or Wellhead Christmas Tree.

A top section of the lubricator assembly, sometimes referred to as a "barrel" or "barrel assembly", features a high pressure tubular and means of sealing as well as a means of attachment to a lower section. The lower section of the lubricator assembly, often referred to as a "yoke" or "yoke assembly", also features a high pressure tubular and sealing mechanism, as well as a method of attachment to the wellhead or blowout preventer stack, BOP. A polished rod, often referred to as a "barrel rod", is housed in and generally extends through the upper and lower sections of the lubricator assembly, and is sealed by the sealing elements therein. The component or tool to be conveyed into the wellhead is mounted to a distal end of the polished rod.

In general there are two current styles of lubricators. A first lubricator style is pressure balanced and manually operated ("PBMO"); a second lubricator style is a hydraulic driven arrangement. Both styles have their distinct disadvantages. The first style, PBMO, is completely manual and poses safety risks to its human operators. The second style requires a large hydraulic power source that typically obtains its power from a truck-mounted internal combustion engine.

For the second or hydraulic style of lubricator, the pressure applied needs to be closely monitored and regulated to ensure the polished rod translates safely in and out of the lubricator. If, for whatever reason, the pressure being applied to a driving piston is not regulated with the well pressure, there is a high probability that the operator could allow the pressure differential between the tool and wellhead to get to a state where the polished rod buckles. This is a known problem experienced by operators currently using this hydraulic style lubricator.

An example of the second or hydraulic type lubricator is shown in US Patent Publication 2012/0024521 to Villa, which is incorporated herein by reference in its entirety, including but not limited to the purpose of showing attachments and connections of a wellhead lubricator. US Patent Publication 2012/0024521 discloses a specialized barrel portion which is provided for attachment to a usual yoke assembly. A piston is secured at or near the upper or proximate end of a tool rod. The outside diameter of the piston approximates the inside diameter of the barrel housing, such that the moveable piston has a snug sliding contact with the inside of the barrel housing. Suitable glands or O-ring packing provide a pressure seal between the piston and the inside wall of the barrel housing, yet permit the piston to undergo reciprocal movement within the barrel housing. Reciprocal movement of the polished rod is provided by regulated hydraulic pressure acting on the faces of the piston.

One notable disadvantage of the system of US Patent Publication 2012/0024521 is that, with pressure in the well, it is necessary to regulate the pressure applied to the piston to pressure above that in the wellhead to be able to move the rod and attached tool reciprocally in and out of the wellhead. Therefore that the power needed to manipulate the polished rod into the wellhead could be significant.

Another disadvantage of the system of US Patent Publication 2012/0024521 is the need to ensure that the polished rod, when it reaches its destination, cannot be overloaded. If the rod were to be overloaded, industry experience shows that the rod, if not substantial in diameter, buckles under the load, resulting in remedial emergency procedures with exposure to a possible live open well situation.

What is needed are efficient and safe lubricator apparatus and methods of operating same.

SUMMARY

In one of its example aspects the technology disclosed herein concerns a wellhead lubricator. In an example embodiment and mode the wellhead lubricator comprises a yoke housing; a first clamp; a second clamp; and, an extensible actuator. The yoke housing comprises a first end configured for connection to a barrel housing and a second end configured for connection to a wellhead. The yoke housing defines a yoke cavity through which a barrel rod extends along an axis of the yoke cavity. The first clamp is situated in the yoke cavity and is configured for selective engagement with the barrel rod. The second clamp is also situated in the yoke cavity and is configured for selective engagement with the barrel rod. The extensible actuator is connected to at least one of the first clamp and the second clamp. The extensible actuator, the first clamp, and the second clamp are configured to be operated in coordinated manner to provide translation of the barrel rod along the axis of the yoke cavity.

BRIEF DESCRIPTION OF THE DRAWINGS

The foregoing and other objects, features, and advantages of the technology disclosed herein will be apparent from the following more particular description of preferred embodiments as illustrated in the accompanying drawings in which reference characters refer to the same parts throughout the various views. The drawings are not necessarily to scale, emphasis instead being placed upon illustrating the principles of the technology disclosed herein.

DETAILED DESCRIPTION

In the following description, for purposes of explanation and not limitation, specific details are set forth such as particular architectures, interfaces, techniques, etc. in order to provide a thorough understanding of the technology disclosed herein. However, it will be apparent to those skilled in the art that the technology disclosed herein may be practiced in other embodiments that depart from these specific details. That is, those skilled in the art will be able to devise various arrangements which, although not explicitly described or shown herein, embody the principles of the technology disclosed herein and are included within its spirit and scope. In some instances, detailed descriptions of well-known devices, circuits, and methods are omitted so as not to obscure the description of the technology disclosed herein with unnecessary detail. All statements herein reciting principles, aspects, and embodiments of the technology disclosed herein, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that block diagrams herein can represent conceptual views of illustrative circuitry or other functional units embodying the principles of the technology. Similarly, it will be appreciated that any flow charts, state transition diagrams, pseudo code, and the like represent various processes which may be substantially represented in computer readable medium and so executed by a computer or processor, whether or not such computer or processor is explicitly shown.

Figure 1:
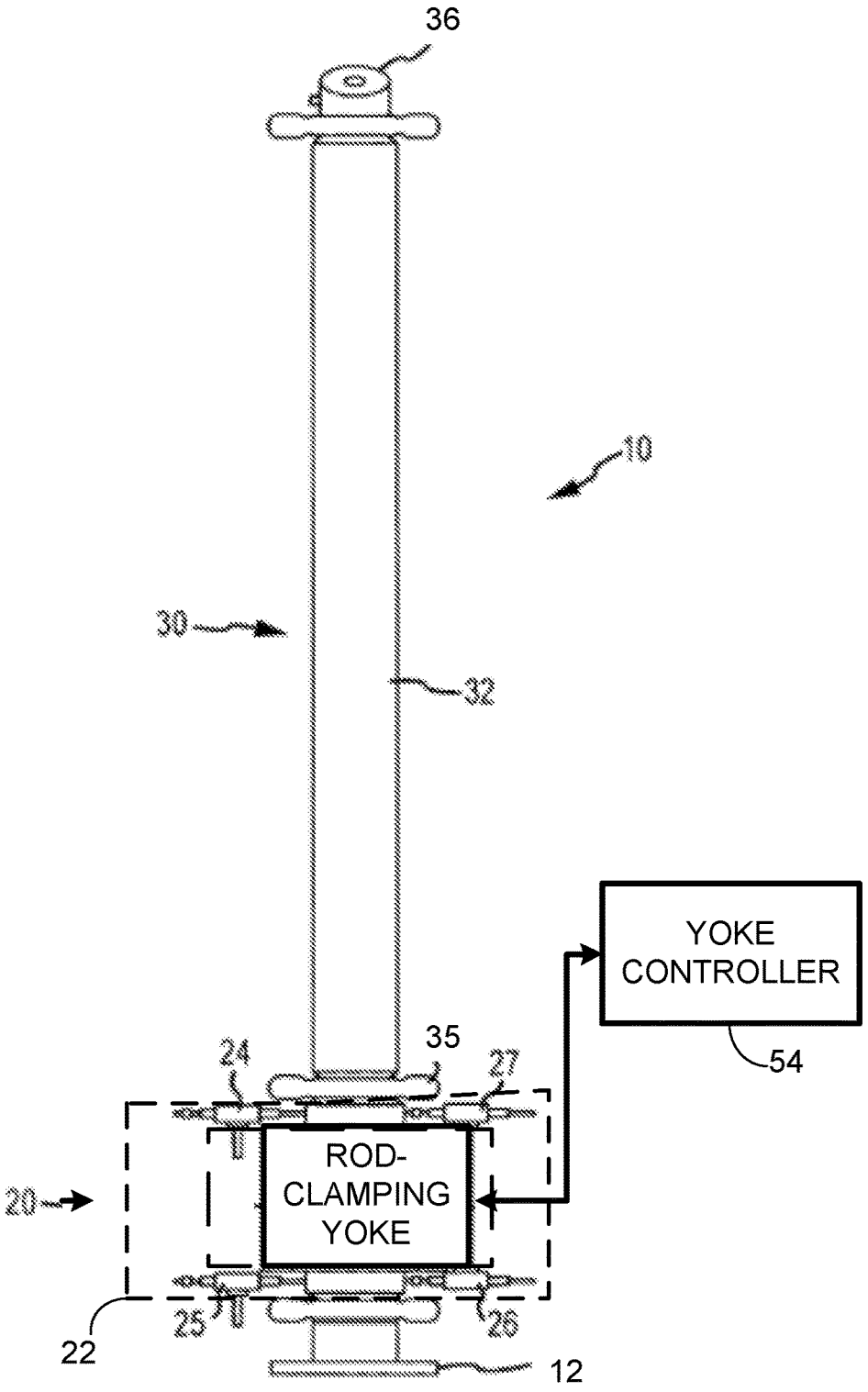
FIG. 1 is a diagrammatic side view of a generic wellhead lubricator according to an example embodiment and mode.
Figure 2:
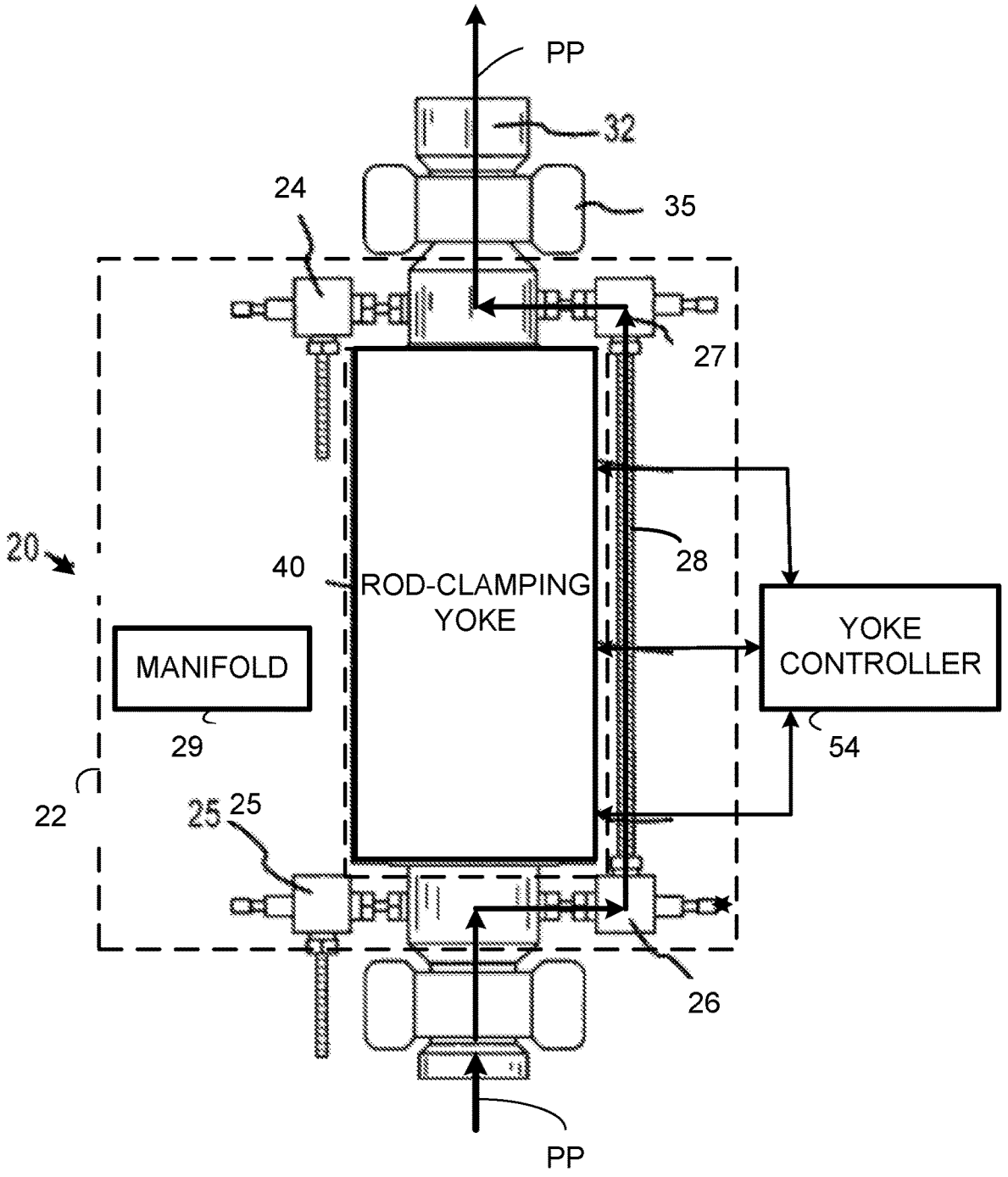
FIG. 2 is an enlarged view of a portion of the lubricator of FIG. 1 and further showing various components used to control operation thereof.

FIG. 1 shows a generic example embodiment and mode of wellhead lubricator 10 for use at a wellhead 12. The wellhead lubricator 10 includes, as one aspect of the technology disclosed herein, wellhead lubricator yoke 20. The lubricator yoke 20 as disclosed herein advantageously comprises clamping structure which provides facile and balanced operation, for which reason lubricator yoke 20 is also illustrated in FIG. 1 and FIG. 2 as "rod-clamping yoke" 20. Various example embodiments and modes of lubricator yokes are described herein, for which the lubricator yoke 20 of FIG. 1 and FIG. 2 are illustrated as and intended to be generic. As explained subsequently, the generic lubricator yoke 20 encompasses example embodiments and modes wherein constituent elements or structures of the lubricator yoke 20 may take different forms or locations.

Figure 3:
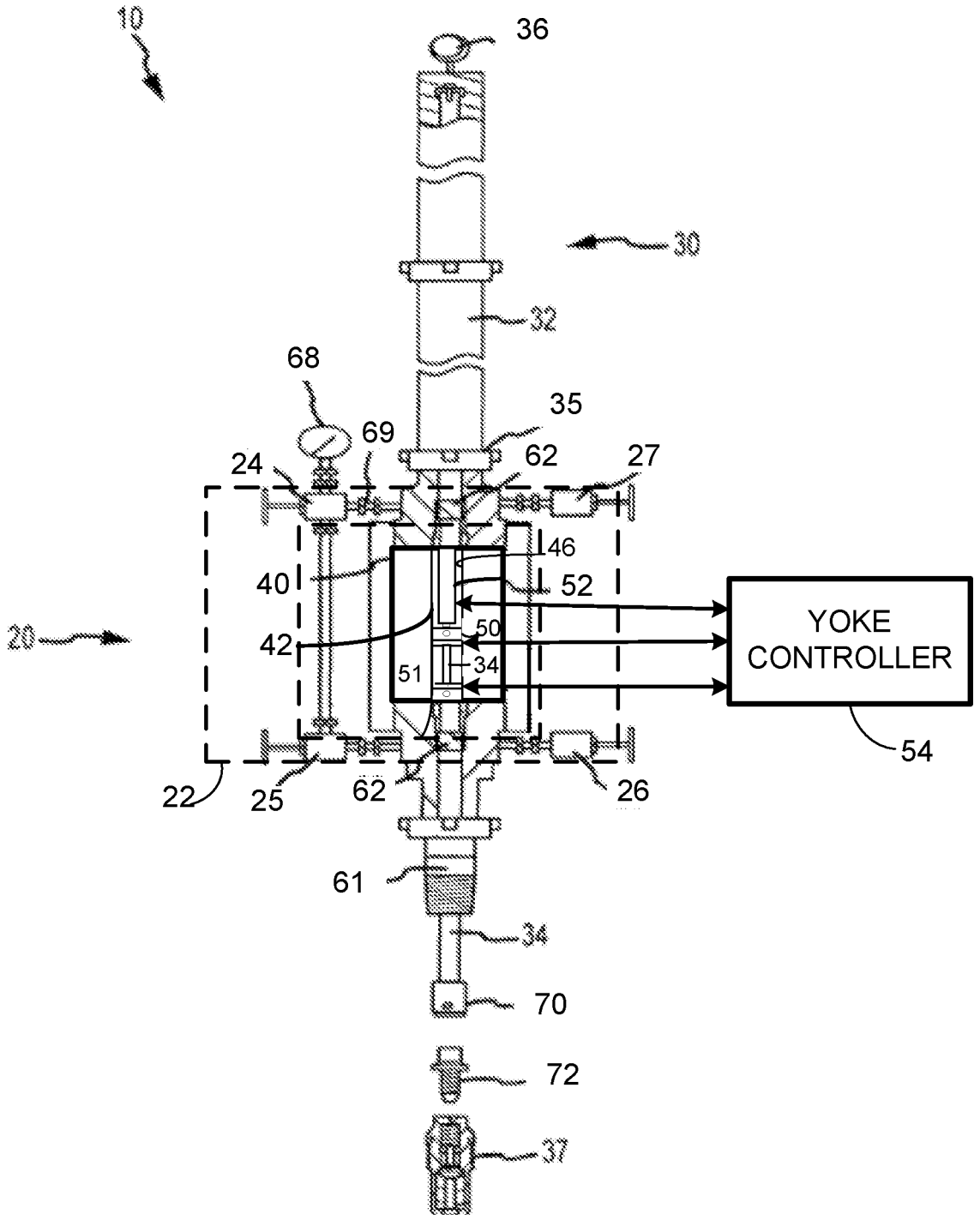
FIG. 3 is a partially exploded, partial sectional side view of a lubricator apparatus according to an example embodiment and mode, showing a barrel portion, a lubricator yoke, and certain components attachable to the distal end of the polished rod.

In this disclosure "up" and "down" and "upper" or "lower" shall have conventional meanings in the frame of reference provided by FIG. 1, FIG. 2, and FIG. 3 in which the apparatus is seen positioned vertically. It should be noted however that this unit is not just limited to use in the vertical plane. It can be used in other planes to aid in the use of wellhead valve removal (VR) plugs. This action enables the servicing of gate valves mounted outboard of a wellhead spool, or tubing head adapter or other wellhead spool fitted with valves and VR plug profile.

The wellhead lubricator of FIG. 1, FIG. 2, and FIG. 3 operates in conjunction with well pressure controller 22. For sake of simplicity well pressure controller 22 is depicted in FIG. 1, FIG. 2, and FIG. 3 by a broken line rectangle that surrounds lubricator yoke 20, for purpose of showing elements encompassed by well pressure controller 22, including a series of pressure values 24, 25, 26, and 27, which may be manually or automatically operated. FIG. 2 shows well pressure controller 22 in more detail and how wellhead pressure may be balanced about lubricator yoke 20 by well pressure controller 22 using the pressure values 24, 25, 26, and 27 and high pressure tubing 28 which extends around the lubricator yoke 20. The pressure values 24, 25, 26, and 27 of well pressure controller 22 may be connected to manifold 29. FIG. 2 shows a pressure path PP, which commences at the bottom of the wellhead lubricator where pressure enters the wellhead lubricator from the wellhead and, as shown in FIG. 2, travels around the lubricator yoke 20 to a barrel portion 30. Thus, as shown in FIG. 2, wellhead pressure is balanced above and below lubricator yoke 20, and thus above and below the yoke housing 40 and the yoke cavity 40 within yoke housing 20. In some example embodiments and modes the well pressure controller 22 may be operated manually, while in other example embodiments and modes well pressure controller 22 may be automatic, or even combined with other controlling operations of lubricator yoke 20.

As also shown in FIG. 1, FIG. 2, and FIG. 3, for example, the lubricator yoke 20 is typically employed in conjunction with the barrel portion 30. The barrel portion 30 comprises a barrel housing 32 which defines a barrel interior bore or hollow cavity. A tool rod, or barrel rod 34, is at least partially accommodated within the interior bore of the barrel housing 32 and is movable coaxially relative to the barrel housing 32. A distal or lower segment of the rod extends from the barrel such that a portion of the barrel rod 34 is accessible through an access window of the yoke portion 20

The bottom of the barrel portion may be securely yet detachably connectable via a connector 35 to the top of the yoke portion 20. An eye or hook 36 may be provided upon the proximate or upper first end of the barrel housing 32 to assist in lifting and manipulating the lubricator 10 into position atop wellhead 12 for use. In known lubricator devices 10 the tool rod is typically moved manually by field operators relative to the barrel 30 and yoke assembly 20 to place or retrieve a back pressure valve, BPV, 37, removably attached to the lower or distal end of the rod 34. Such movement is accomplished manually in which one or more operators grip the polished rod 34, typically with a parmalee wrench, where the rod 34 is accessible in an open window of the yoke assembly 20. Using a parmalee wrench the operators manipulate the rod 34 up and down within the lubricator 10.

Figure 4:
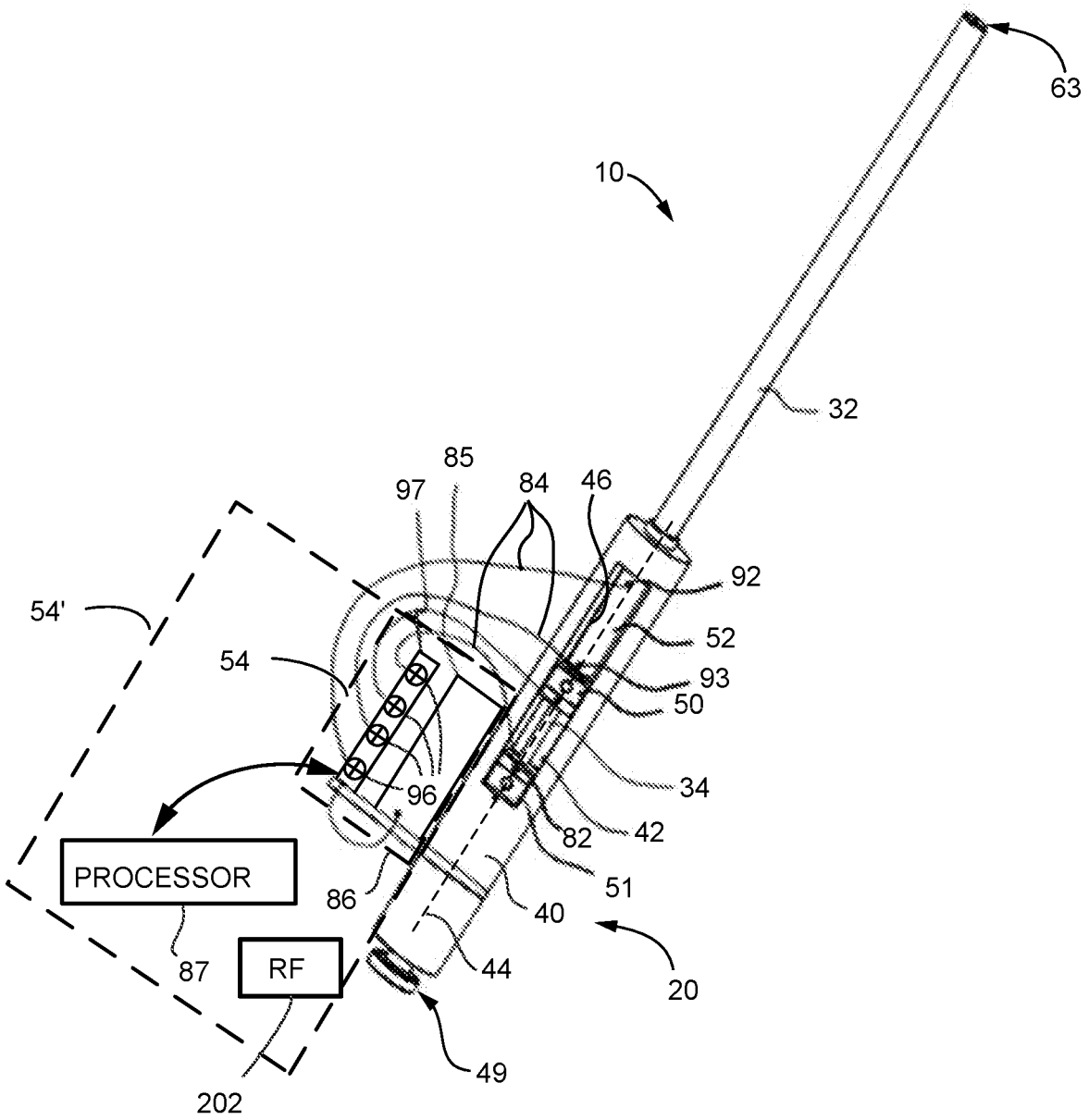
FIG. 4 is a diagrammatic side view of an example embodiment and mode showing example lubricator yoke components mounted coaxially with the polished rod, the lubricator yoke shown in conjunction with hydraulic hoses and valving to equalize pressure in the lubricator and control the movement of the polished rod into and out of a wellhead.

In its generic form, lubricator yoke 20 according to the technology disclosed herein, as shown in an example embodiment and mode of FIG. 3 and FIG. 4, comprises yoke housing 40. The yoke housing 40 comprises a first or upper end configured for connection to barrel housing 32 and a second or lower end configured for connection to a wellhead. The connections may be threaded or flanged or a combination thereof. As shown in FIG. 3 and FIG. 4, the yoke housing 40 may define a yoke cavity 42 through which barrel rod 34 extends along an axis 44 of the yoke cavity. The yoke housing 40 may also have a radial opening or yoke window 46 through which the yoke cavity 42 communicates or is exposed to the exterior of the yoke housing 40. The yoke window 46 provides access to the yoke cavity 42, and is sized in terms of axial and circumferential extent to accommodate such access and, where appropriate, insertion or protrusion of elements such as control lines, e.g., hydraulic lines, and auxiliary elements, such as those herein described by way of example.

In addition to yoke housing 40, in an example embodiment and mode lubricator yoke 20 also comprises first clamp 50; second clamp 51; extensible actuator 52. The first clamp 50 is situated in the yoke cavity 40 and configured for selective engagement with the barrel rod 34. The second clamp 51 is also situated in the yoke cavity 40 and configured for selective engagement with the barrel rod 34. As used herein, "selective engagement" means selective engagement/disengagement of the first clamp, e.g., selective engagement and/or selective disengagement, and thus may be interpreted as meaning engagement or disengagement depending on sequencing of signals and/or pressure applied thereto.

The extensible actuator 52 is connected to at least one of the first clamp 50 and the second clamp 51, depending on implementation. In some example embodiments and modes the extensible actuator 52 takes the form of a cylinder having a piston which extends and retracts. That is, the extensible actuator 52 is operable so that its piston is either in an extended position or a retracted position, with the extensible actuator 52 itself being referred to as extended or retracted accordingly.

Figure 6:
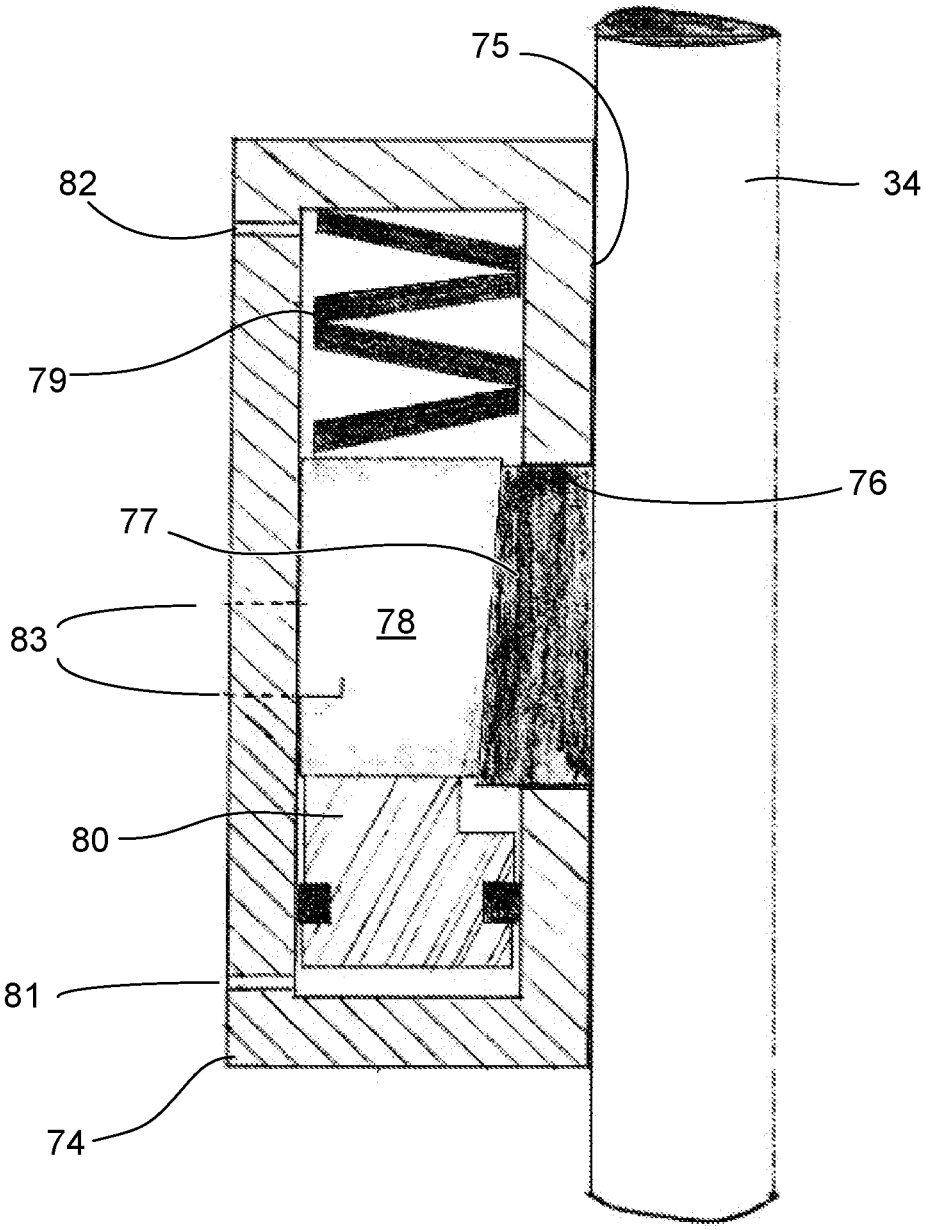
FIG. 6 is a cross-sectional view of an example embodiment and mode of a clamp of a lubricator yoke according to an example embodiment and mode.

In some example embodiments and modes the yoke housing 40 may be provided with yoke controller 54. The yoke controller 54 is configured to actuate the extensible actuator 52, to actuate the selective engagement of the first clamp 50, and to actuate the selective engagement of the second clamp 51 in coordinated manner to provide translation of the barrel rod 34 along the axis 44 of the yoke cavity 40. By "actuate" the extensible actuator 52 is meant that the yoke controller 54 causes the extensible actuator 52 to acquire either its extended or its retracted position. By "selective engagement" of a clamp is meant that the yoke controller 54 causes the clamp, e.g., first clamp 50 or second clamp 51, to either securely engage or lock on to the barrel rod 34, or to release/disengage from the barrel rod 34. A non-limiting example of structure that facilitates engagement and disengagement of the barrel rod 34 by the clamps is shown in FIG. 6.

Figure 7:
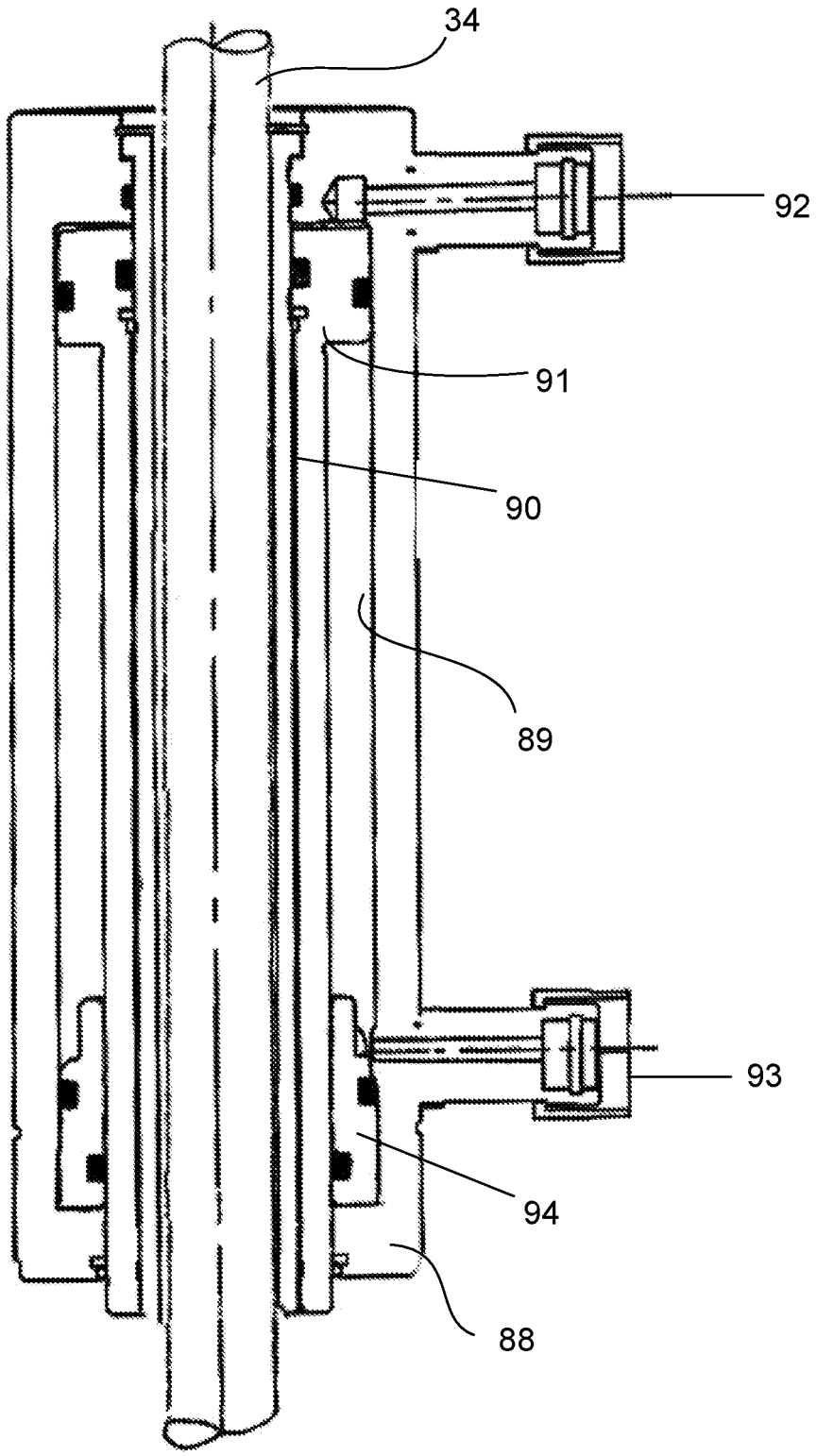
FIG. 7 is a cross-sectional view of an example embodiment and mode of a clamp of a hydraulic extensible actuator according to an example embodiment and mode.

In some example embodiments and modes, such as those of FIG. 3 and FIG. 4, extensible actuator 52 of lubricator yoke 20 may be located in yoke cavity 42. In particular extensible actuator 52 may be situated in the yoke cavity 42 and co-axially mounted about the barrel rod 34. In other words, extensible actuator 52, which typically has a cylindrical shape, may have its cylindrical axis aligned with axis 44 of the yoke cavity and the axis of barrel rod 34. A non-limiting example of structure of an example hydraulic extensible actuator 52 is shown in FIG. 7.

For the example embodiments and modes in which the extensible actuator 52 may be located in yoke cavity 42, the positioning or location of the extensible actuator 52 relative to first clamp 50 and second clamp 51 may vary depending on particular implementation. For example, in the example implementation shown in FIG. 3 and FIG. 4, the extensible actuator 52 is positioned above both first clamp 50 and second clamp 51 in yoke housing 40. In particular, extensible actuator 52 is connected to the first clamp 50 and is situated in the yoke cavity 40 between the yoke housing first or upper end and the first clamp 50. Second clamp 51 is situated in the yoke cavity 40 between the first clamp 50 and the yoke housing second or lower end.

For sake of present discussion, it is assumed that the controller 54 of the example embodiment and mode of FIG. 3 and FIG. 4 controls operation of the lubricator yoke 20 hydraulically, and that extensible actuator 52 is an hydraulic actuator. Accordingly, various hydraulic connections and a hydraulic extensible actuator 52 are described below with reference to FIG. 3 and FIG. 4. However, as explained further below, it should be understood that other types of control, and other types of extensible actuators, such as electrical and/or magnetic, are utilized in other example embodiments and modes.

FIG. 3 further shows that the yoke assembly 20 may include a union male 61, with nut, on the adapter end, for securely yet removably connecting the yoke assembly 20 (and thus the lubricator 10) to the wellhead 12 according generally to convention. Similarly, a connector 35 such as a female union on the extension end of the lubricator yoke assembly 20 may provide for a screwed connection of any of a variety of sizes/lengths of barrel housing 32. Switching of barrel sizes permits the use of barrel rods 34 of different lengths, to customize the lubricator 10 to the particular application or the heights of different BOPs or Christmas trees. The lubricator yoke 20 may further be utilized in conjunction with or comprise two packing glands 62 to retain fluid pressures within the lubricator during use. As explained above in conjunction with well pressure controller 22, for hydraulic implementations, four needle valves 24, 25 26, and 27 may be used to equalize and bleed off pressure in the lubricator, according to US 2012/0024521, for example, which is incorporated herein by reference in its entirety. A pressure gauge 68 normally may be installed in the cross portion on the lubricator manifold 69 of the lubricator yoke 20.

FIG. 3 also shows how the distal end of barrel rod 34 may be utilized. In this regard FIG. 3 shows that a polished rod adapter 70 may be removably but reliably attached to the distal end of the barrel rod 34, as by means of a pin-and-channel connection. The polished rod adapter 70 permits a running and retrieving tool 72 (any of a number of running tools known in the art) to be securely but releasably connected to the distal end of the barrel rod 34. Such connections often are by means of special set screw type junctions. Running and retrieving tools include, for example, solid stinger type running tools, or sliding thread type running and retrieving tools for larger BPV's 37. The running tool 72 in turn may have a threaded engagement with any of a number of tools, particularly for instance, a BPV 37 of selected and suitable type and specification.

Figure 5:
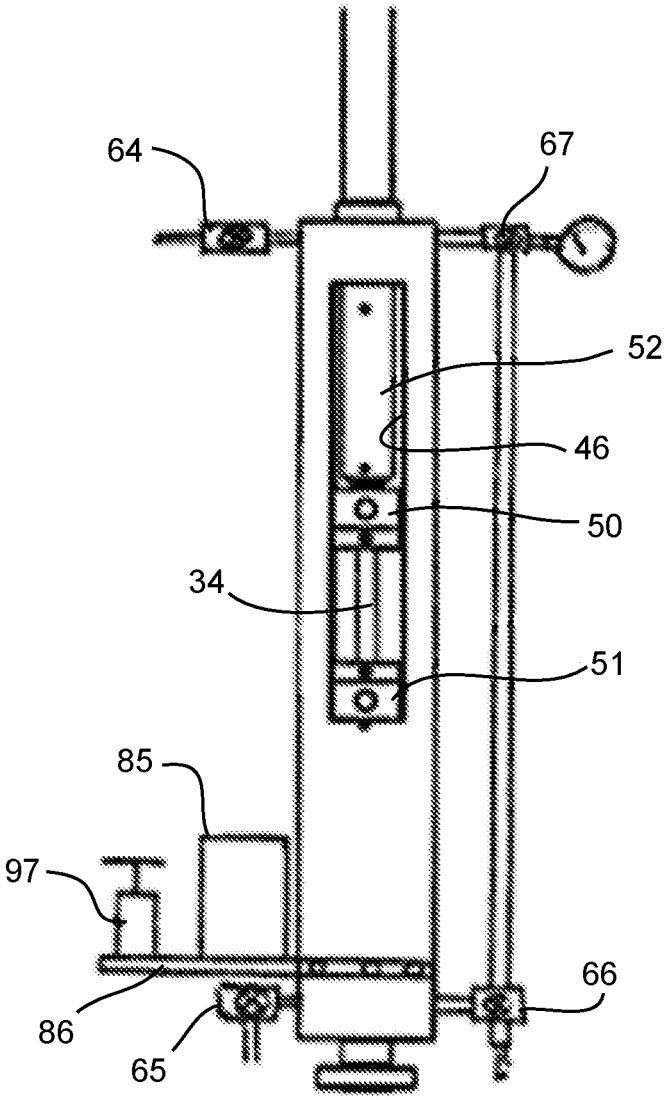
FIG. 5 is a diagrammatic side view of an example embodiment and mode of a lubricator yoke without the hydraulic hoses.

The example embodiment and mode of FIG. 3, FIG. 4 and FIG. 5 shows how the technology disclosed herein overcomes the disadvantages of both prior art manual and prior art high pressure hydraulic wellhead lubricators. The lubricator assembly 10 of FIG. 4 comprises components of a pressure balanced manually operated (PBMO) assembly such as lubricator yoke 20 with pressure isolation packing included in the upper and lower yoke portions. Manifold arrangement with needle valves 24, 25, 26, 27 enables the unit to be completely pressure balanced, e.g., when wellhead pressure changes it equalizes above and below the lubricator yoke 20. Included in lubricator yoke 20 are the hydraulic components that enable the safe manipulation of the polished rod 34 in to and out of the wellhead 12.

The lubricator yoke 20 of FIG. 4 comprises second clamp 51 located at and removably attached to the bottom of the yoke that is always active by the use of a spring mechanism mounted internally therein. The first clamp 50 is removably attached to a hydraulic cylinder 52 in the upper portion of the yoke housing 40. In an example embodiment and mode such as that shown in FIG. 6, the clamp is always active and locked to the polished rod, e.g., barrel rod 34, by the use of a spring mechanism mounted internally therein, preventing the polished rod 34 from moving into or out of the wellhead.

FIG. 6 shows a cross-sectioned portion of first clamp 50, but it should be understood that clamp 51 may and preferably does have identical structure, although with different operational timing. The first clamp 50 of FIG. 6 comprises clamp housing 74 which has a hollow cylindrical shape. The hollow of clamp housing 74 comprises clamp cavity 75, having a central axis which is aligned with the axis of barrel rod 34. The clamp cavity 75 is configured and sized to centrally accommodate barrel rod 34. At an intermediate location along its axial interior a clamping window 76 is provided through the clamp housing 74 for communication with the clamp cavity 75. The clamp cavity 76 accommodates clamping ring 77, which has an interior circumferential surface oriented to engage the barrel rod 34 when actuated to do so. An outer circumferential surface of clamping ring 77 is beveled to mate with a counter-beveled inner circumferential surface of locking wedge 78. The locking wedge 78 is positioned radially exteriorly to clamping ring 77, but is slidable along the major cylindrical axis of clamp housing 74, e.g., parallel to the axis of barrel rod 34, as locking wedge 78 is acted upon by clamp spring 79 and clamp piston 80. The clamp piston 80 is situated in a space at the bottom of clamp housing 74, and has a radial upper surface that contacts a radial bottom surface of locking wedge 78. The clamp piston 80 is actuated to move axially upwardly in clamp housing 74 when hydraulic pressure is applied to hydraulic pressure port 81 formed in an lower outer circumferential surface of clamp housing 74 and hydraulic pressure withdrawn from pressure relief/breather hole 82 formed in an upper outer circumferential surface of clamp housing 74. The hydraulic pressure port 82 communicates with an interior upper chamber of clamp housing 74 wherein clamp spring 79 is situated. The clamp spring 79 is biased to apply downward pressure on locking wedge 78, so that the interior beveled surface of locking wedge 78 pushes clamping ring 77 into locking engagement with barrel rod 34. However, when hydraulic pressure is withdrawn through hydraulic pressure port 82 and applied through hydraulic pressure port 81, the clamp piston 80 is pushed upwardly so as to overcome the bias of clamp spring 79, and thereby move locking wedge 78 upwardly, so that the beveled interior circumferential surface of locking wedge 78 slides axially. The upward slide of locking wedge 78 causes clamping ring 77 to loosen against barrel rod 34, so that barrel rod 34 is free to translate along its axis. The position of locking wedge 78 is sensed by proximity sensors 83.

The clamp structure of FIG. 6 is provided as only one example implementation. Other suitable clamps or clamping means may alternatively be utilized.

In one non-limiting example embodiment and mode, hydraulic cylinder 52 is removably attached to the upper portion of the yoke assembly, e.g., to the upper portion of yoke housing 40. As shown by way of example in FIG. 4, hydraulic cylinder 52 and each of first clamp 50 and second clamp 51 have hydraulic hoses 84 connecting to a small, low power hydraulic power unit, HPU, 85. The hydraulic power unit 85 may either stand alone or mounted to a plinth 86 removably attached to the yoke assembly.

FIG. 7 is a cross-sectional view of an example double acting hydraulic extensible actuator 52 according to an example embodiment and mode. The extensible actuator 52 comprises an essentially cylindrical actuator housing 88 which has actuator central axial cavity 89. At its two axial ends the actuator central axial cavity 89 has diameter sufficient to accommodate the barrel rod 34, but intermediate the two axial ends the actuator central axial cavity 89 has a larger diameter sized to accommodate actuator piston 90. The actuator piston 90 has an enlarged piston head 91, above which an upper hydraulic inlet/outlet 92 is located in cylindrical actuator housing 88. A lower hydraulic inlet/outlet 93 is shown in FIG. 7 above lower piston seal 94. Motion of actuator piston 90 within extensible actuator 52 is controlled by flow of hydraulic fluid into the actuator central axial cavity 89 above piston head 91 and counter-flow of hydraulic fluid into the actuator central axial cavity 89 below piston head 91 and above lower piston seal 94.

The actuator element structure of FIG. 7 is provided as only one example implementation. Other suitable actuator element structures or actuating means may alternatively be utilized.

The example, non-limiting hydraulic cylinder 52 of FIG. 4, FIG. 5, and FIG. 7 operates on the basic principle of a double acting hydraulic cylinder: application of pressure on one side, e.g., in the example of FIG. 4 to upper hydraulic inlet/outlet 92 of the hydraulic cylinder 52, to move the cylinder rod 34 with clamp 50 attached removably to the polished rod 34 down into the wellhead. Simultaneously pressure is applied to the lower clamp 51 through port 82 to release its clamping force on the rod 34. On completion of the stroke and at a preset pressure the hydraulic power unit 85 stops applying pressure and the clamps 50, 51 activate and hold the polished rod in place. The lower clamp 51 remains active and the upper clamp 50 is deactivated and the pressure is reversed on the hydraulic cylinder via port 93 returning the cylinder back to its starting position. The next step in the process is again to activate the upper clamp 50 to grip the polished rod 34. The lower clamp 51 is deactivated and releases its grip on the polished rod 34. Pressure is once again supplied to the hydraulic cylinder 52 through port 92 thereby moving the polished rod 34 with BPV 37 attached into the wellhead 12. The sequence is continued until the BPV 37 and barrel rod 34 reach their destination.

Since the barrel rod 34 of lubricator yoke 20 is continually pressure balanced throughout the process, a non-limiting example scenario of which has just been described above in an example, non-limiting, hydraulic context, there is no need for sophisticated monitoring equipment. With a completely pressure balanced rod the pressure of the hydraulic power unit 85 may be limited so as to ensure there is no chance of applying a load that would buckle the barrel rod 34 when the unit contacts its mating component in the wellhead. It is at this point the component attached to the polished rod 34 can be rotated to engage the threads of the BPV 37 with the threads located in the downhole component to block off the pressure from below. Rotation may be achieved using a parmalee wrench attached to the barrel rod 34 through the yoke window 46. If it is not a threadably engaging component, e.g., one that has a shear release mechanism, the hydraulic cylinder 52 can be used to provide the required amount of force to release the mechanism.

FIG. 4 shows a basic form of the yoke controller 54 as comprising a series of valves 96 mounted to a manifold 97 located on or near hydraulic power unit 85. The hydraulic power unit 85 and manifold 97 may be operated manually, e.g., by levers, for example. Thus hydraulic power unit 85 with manual activation may be one form or implementation of yoke controller 54. The controller 54 may be manually operated in non-hydraulic embodiments as well. In other implementations the hydraulic power unit 85 may be operated automatically, e.g., by air, hydraulic or electric power.

In some example embodiments and modes the operation of lubricator yoke 20, including hydraulic power unit 85 in hydraulic implementations, is under control of processor circuitry 87. In this regard FIG. 4 further shows that a yoke controller 54' may include processing circuitry 87 which controls the elements connected to first clamp 50, second clamp 51, and extensible actuator 52, whether such elements be hydraulic in the manner shown in FIG. 4 or otherwise. Thus "controller" and "yoke controller" as used herein may take the form of and/or comprise processor circuitry. Thus, in the hydraulic embodiments for example, the hydraulic power unit 85 and therefore the sequencing of where pressure is to be applied and removed, may be managed by a programmable device, for example a computer.

FIG. 4 further shows that, in another example embodiment and mode, the yoke controller 54 may optionally be combined with the well pressure controller 22

In some example embodiments and modes the controller 54 may be connected to a radio frequency or other type of transceiver such as radio interface circuitry 202, and thereby operated remotely by a field service engineer.

As understood from the foregoing and now further explained, in a non-limiting example embodiment and mode, the controller 54 of lubricator yoke 20 in a hydraulic implementation is operable to translate the barrel rod along the axis by a sequence of acts or steps described in Table 1. The description of Table 1 is with reference to the example embodiment and mode of FIG. 3, FIG. 4 and FIG. 5. In Table 1, in its starting position the wellhead lubricator 10 is installed on the well with BPV attached. At the start, the low power hydraulic power unit, HPU 85 not engaged (no pressure created), and clamps 50 & 51 are engaged on the polished rod 34 due to the action of the springs acting on the locking wedge in the clamps (FIG. 6).

TABLE 1

A. Sequence to enable moving the rod and BPV in to the well (Referring to FIGS. 3, 4, & 5). Manual Version.
   1. Apply pressure to clamp 51 - disengages spring and unlocks its grip on rod 34
   2. Apply pressure to port 92 of the Hydraulic Cylinder - advances rod 34 and attached components in to the well until it reaches the end of the HC stroke.
   3. Remove pressure from clamp 51 - Spring engages locking mechanism enabling clamping of the rod 34.
   4. Remove pressure from HC
   5. Apply pressure to clamp 50 - disengages locking mechanism releasing its hold on rod 34
   6. Apply pressure to port 93 on hydraulic cylinder - returns HC to its starting position.
   7. When starting point is reached remove pressure from clamp 50 - allowing it to lock on to the rod 34
   8. Repeat steps 1 through 7 until desired depth (stroke) is reached
   9. BPV may be manually set by rotation of rod 34 using parmalee wrench B. Sequence to enable moving the rod and BPV out of the well (Referring to FIGS. 3, 4, & 5). Manual Version using parmalee wrenches. Starting position would be when the BPV has been disengaged from the wellhead by rotation. Both clamps would be pressurized and the HC would be depressurized. Ready to stroke out of the well.
   1. Depressurize clamp 50 - allowing it to lock on to the rod 34
   2. Pressurize HC via port 93 - moving rod and BPV desired stroke length of HC
   3. At end of stroke - depressurize clamp 51- allowing it to engage with rod 34
   4. Depressurize HC
   5. Pressurize clamp 50 - disengaging from rod
   6. Pressurize HC via port 92 - moving the HC back down toward the wellhead and bottom of yoke window
   7. At end of stroke - depressurize clamp 50 - allowing it to lock on to the rod
   8. Repeat steps 2 through 7 until the rod 34 has moved out of the well the desired distance.

TABLE 1-continued

| |
|---|
| C. Sequence to enable moving the rod into the well then using the motorized gear box mechanism to install the BPV in the tubing hanger. Ref FIGS. 3, 4, 5 & 10<br>1. Apply pressure to clamp 51 - disengages spring and unlocks its grip on rod 34<br>2. Apply pressure to port 92 of the Hydraulic Cylinder - advances rod 34 and attached components in to the well until it reaches the end of the HC stroke.<br>3. Remove pressure from clamp 51 - Spring engages locking mechanism enabling clamping of the rod 34.<br>4. Remove pressure from HC<br>5. Apply pressure to clamp 50 - disengages locking mechanism releasing its hold on rod 34<br>6. Apply pressure to port 93 on hydraulic cylinder - returns HC to its starting position.<br>7. When starting point is reached remove pressure from clamp 50 - allowing it to lock on to the rod 34.<br>Repeat steps 1 through 7 until desired depth (stroke) is reached<br>8. On reaching the desired depth - depressurize hydraulic cylinder<br>9. Apply pressure to clamp 50 - disengaging it from the rod<br>10. Activate motor 100 to rotate gearing within gearbox 102, connected to clamp 51<br>11. Continue rotation until desired stroke length has been achieved<br>12. Apply necessary torque to fully engage BPV into the tubing hanger |
| D. Steps required to remove BPV from Tubing hanger automatically<br>Sequence to enable moving the rod and BPV out of the well (Referring to FIGS. 3, 4, 5 & 10) utilizing the motorized gearbox version. Starting position would be when the polished rod is connected to the BPV Clamp 50 would be pressurized and the HC would be depressurized. Clamp 51 would be depressurized.<br>1. Activate motor 100 to rotate gearing within gearbox 102, connected to clamp 51<br>2. Continue rotation until BPV has been completely unthreaded from the tubing hanger<br>3. Depressurize clamp 50 - allowing it to lock on to the rod 34<br>4. Pressurize HC via port 93 - moving rod and BPV desired stroke length of HC<br>5. At end of stroke - depressurize clamp 51- allowing it to engage with rod 34<br>6. Depressurize HC<br>7. Pressurize clamp 50 - disengaging from rod<br>8. Pressurize HC via port 92 - moving the HC back down toward the wellhead and bottom of yoke window<br>9. At end of stroke - depressurize clamp 50 - allowing it to lock on to the rod<br>10. Repeat steps 4 through 9 until the rod 34 has moved out of the well the desired distance. |

It is understood from the foregoing how controller 54 is also operable to translate the barrel rod 34 along the axis in a second direction opposite the first direction.

The foregoing are examples of how the yoke controller 54 is configured to actuate the extensible actuator, the selective engagement of the first clamp, and the selective engagement of the second clamp in coordinated manner to provide translation of the barrel rod along the axis of the yoke cavity.

In the foregoing operation(s), and as understood with reference to FIG. 6 and FIG. 7, the clamping rings 77 are spring energized and therefore they are already engaged with barrel rod 34 at initial assembly. Moreover, hydraulic pressure is applied to a clamp to disengage it from barrel rod 34. If, for whatever reason, hydraulic pressure is lost, the springs 79 will engage the clamp with the rod 34 again. The sequence may involve application of pressure to the lower clamp 51 to disengage it from barrel rod 34, then application of pressure to the hydraulic cylinder 52 (which is attached to the upper clamp 50 which is still engaged with the rod 34) to advance the rod 34 into the wellhead 12. At the end of the stroke the pressure is released from the lower clamp 51 thereby allowing second clamp 51 to engage barrel rod 34, then applying pressure to the upper clamp 50 so that clamp 50 releases its grip on barrel rod 34. Pressure is then applied to the lower port 93 of the hydraulic cylinder 52, returning hydraulic cylinder 52 to its starting location. The pressure is then released from the upper clamp 50, allowing clamp 50 to engage barrel rod 34. Pressure is simultaneously released from the hydraulic cylinder 52. Thereafter pressure is applied once again to the lower clamp 51. The above sequenced is followed until the required tool travel had been achieved.

Figure 8:
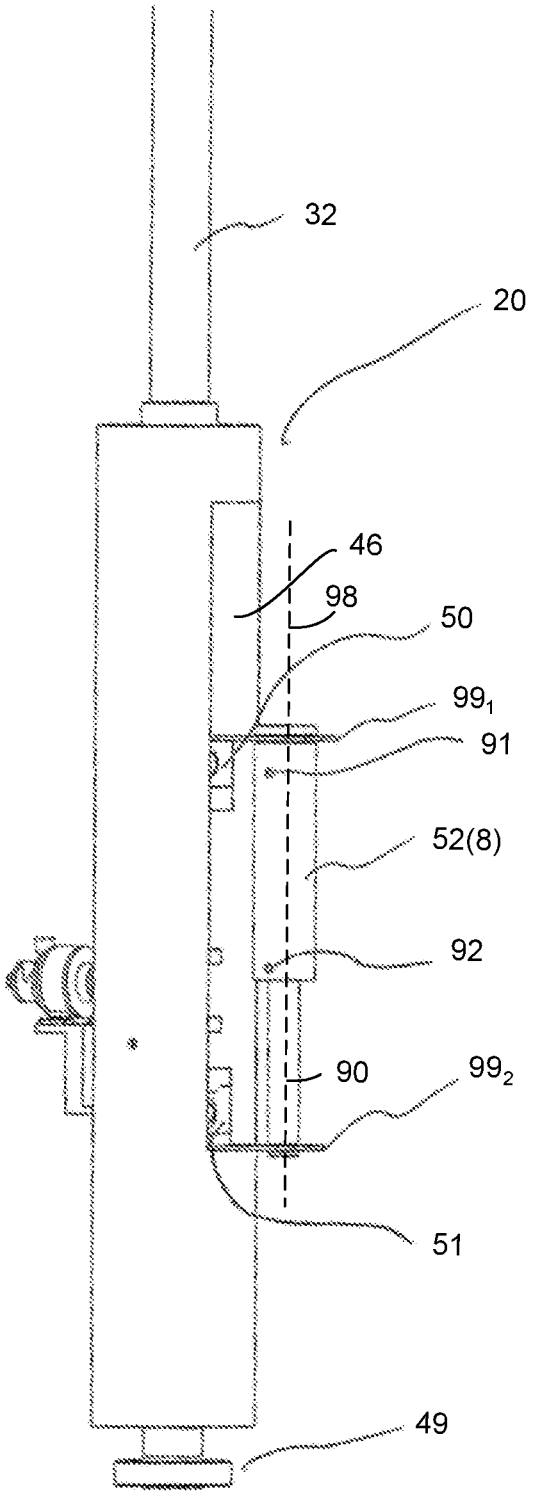
FIG. 8 is a side perspective view a lubricator yoke wherein an extensible actuator is external to a yoke cavity.
Figure 9A:
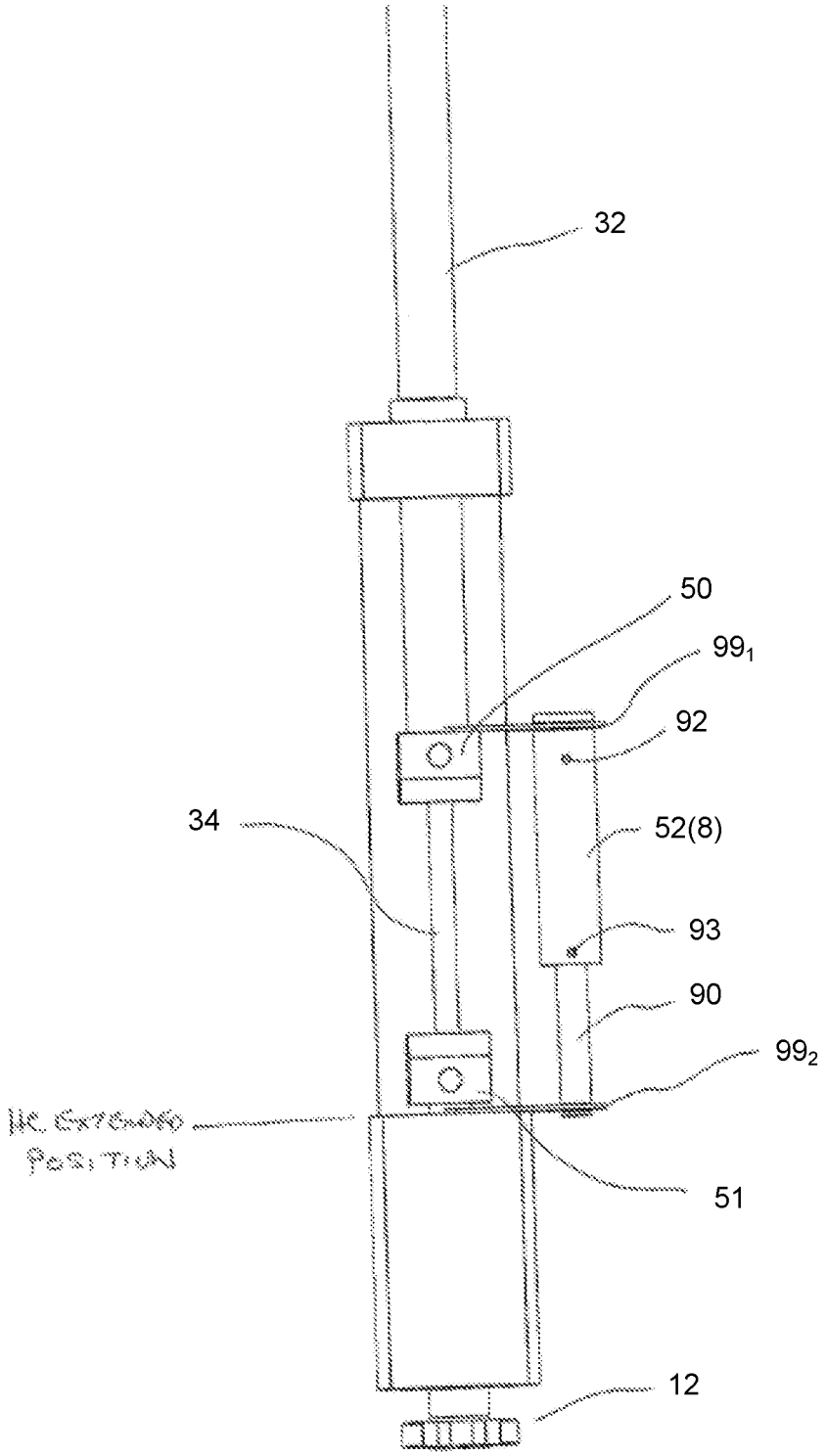
FIG. 9A is a side cross-sectional view of the lubricator yoke of FIG. 8 showing an actuator piston in an extended position.
Figure 9B:
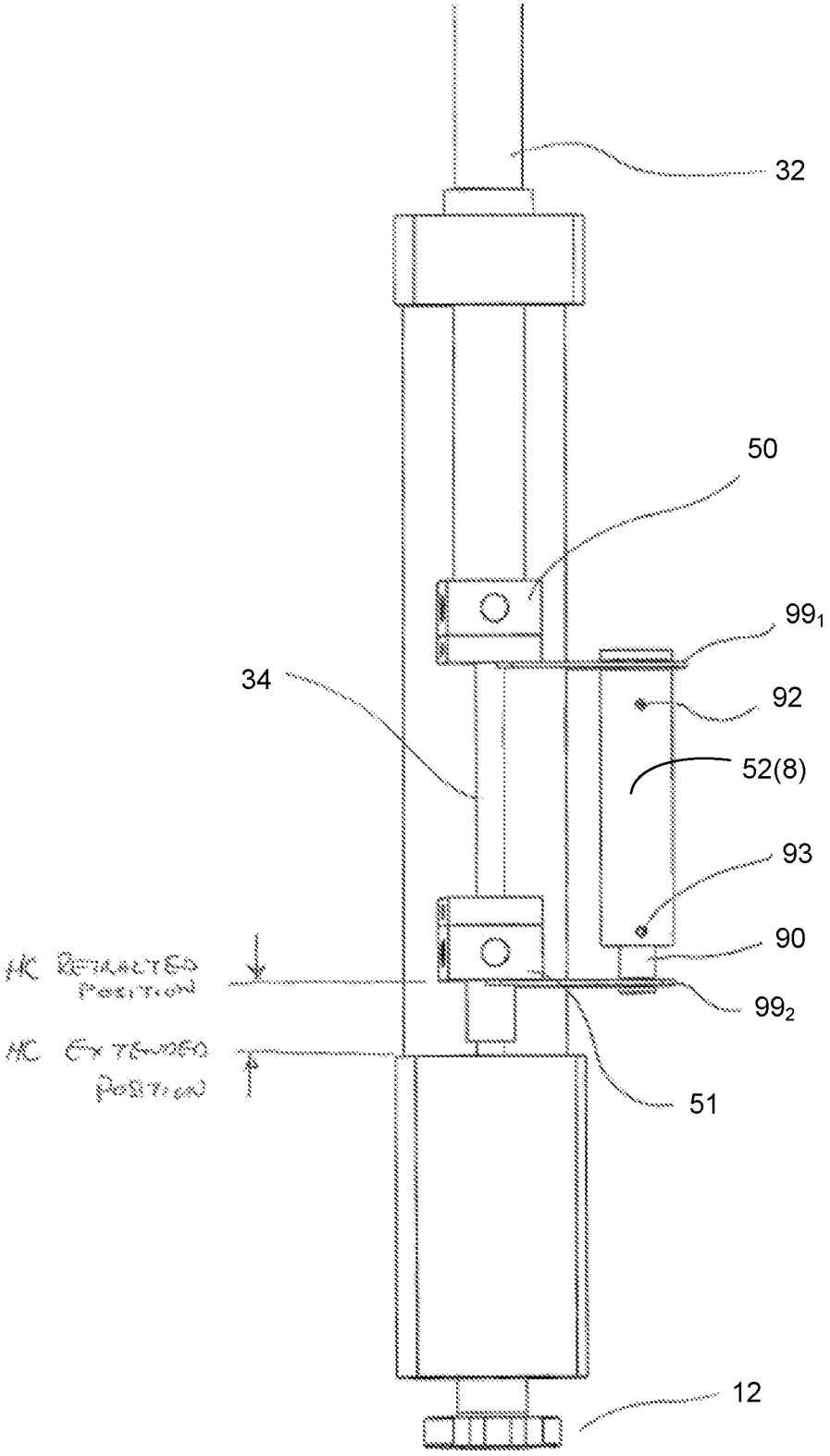
FIG. 9B is a side cross-sectional view of the lubricator yoke similar to that of FIG. 8 showing an actuator piston in a retracted position.

In some example embodiments and modes such as those described above, the extensible actuator 52 is positioned in yoke cavity 42. In other example embodiments and modes the extensible actuator 52 is positioned elsewhere, e.g., exterior or external to yoke cavity 42. FIG. 8, FIG. 9A, and FIG. 9B show an example embodiment and mode wherein the extensible actuator 52(8) is external to yoke cavity 42. FIG. 9A is a side cross-sectional view of the lubricator yoke of FIG. 8 showing actuator piston 90 of extensible actuator 52(8) in an extended position; FIG. 9B is a side cross-sectional view of the lubricator yoke of FIG. 8 showing actuator piston 90 in a retracted position.

Not only do FIG. 8, FIG. 9A, and FIG. 9B provide a non-limiting example of a differing radial location (e.g., outside of yoke cavity 42) of the extensible actuator, but FIG. 8, FIG. 9A, and FIG. 9B also provide a non-limiting example of a differing axial location of the extensible actuator (e.g., extensible actuator 52(8) is situated axially between first clamp 50 and second clamp 51). In particular, in FIG. 8, FIG. 9A, and FIG. 9B the extensible actuator 52(8) is connected to both the first clamp 50 and to the second clamp 51. The extensible actuator 52(8) is situated radially exterior to the yoke cavity 42 along an actuator axis 98 which is parallel to the 44 axis of the yoke cavity 42. As shown in FIG. 8, FIG. 9A, and FIG. 9B, the proximal end of extensible actuator 52(8) is connected to the first clamp 50 by a first connector 991; the distal end of extensible actuator 52(8), e.g., the distal end of actuator piston 90, is connected to the second clamp 51 by a second connector 992. The connectors 99 extend in the radial direction from their respective clamps through yoke window 46 to connect the respective clamp and the extensible actuator 52(8).

Whereas FIG. 9A shows the connectors 99 attached to extreme axial ends of the respective clamps 50 and 51, FIG. 9B shows that, as an alternative, the connectors 99 may be attached to other portions of the respective clamps 50 and 51, such as the opposing axial ends of the respective clamps. In both example, the extensible actuator 52(8) is situated between the connectors 99 to the respective clamps, and the connectors 99 extend through the yoke window 46 provided in yoke housing 40.

For the example embodiment and mode of FIG. 8, FIG. 9A, and FIG. 9B, the yoke controller 54 has a different operation than for the FIG. 4 embodiment. For the example embodiment and mode of FIG. 8, FIG. 9A, and FIG. 9B the controller is operable to translate the barrel rod along the axis of the yoke cavity in a first direction toward the wellhead by:

(1) deactivating engagement of the second clamp 51 with the barrel rod 34;

(2) activating retraction of the extensible actuator 52(8);

(3) activating engagement of the second clamp 51 with the barrel rod 34;

(4) deactivating engagement of the first clamp 50 with the barrel rod 34;

(5) activating extension of the extensible actuator 52(8); and (6) activating engagement of the first clamp 50 with the barrel rod 34.

The foregoing are further examples of how the yoke controller 54 is configured to actuate the extensible actuator, the selective engagement of the first clamp, and the selective engagement of the second clamp in coordinated manner to provide translation of the barrel rod along the axis of the yoke cavity.

In the example embodiment and mode of FIG. 8, FIG. 9A, and FIG. 9B the structural elements of the lubricator yoke which are the same as preceding example embodiments and modes bear the same or similar reference numerals. It should further be understood that, unless otherwise stated or clear from the context, comments applicable to the preceding example embodiments and modes are also applicable to FIG. 8, FIG. 9A, and FIG. 9B.

Figure 10:
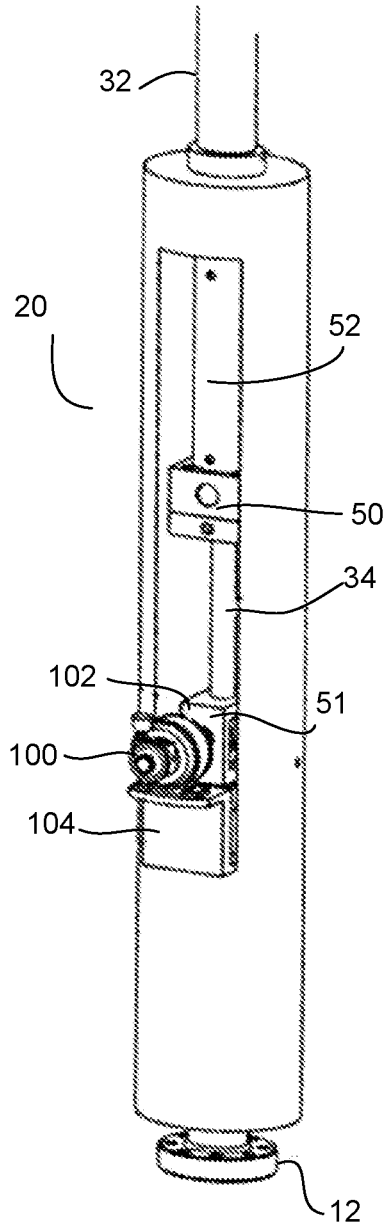
FIG. 10 is a side view of a lubricator yoke according to an example embodiment and mode which additionally employs a torque applicator.

FIG. 10 shows that the lubricator yoke 20 may, as an optional feature, further comprise torque applicator 100. The torque applicator 100 may be connected to at least one of the first clamp 50 and the second clamp 51. The torque applicator 100 is configured to rotate the barrel rod 34 about the axis 44 of the yoke cavity. For example, the torque applicator 100 may serve to rotate the polished rod 34 once the BPV 37 has reached its destination. A gearbox 102 is removably attached to the lower clamp 50. The gearbox 102 is connected to power means such as an electric motor, hydraulic motor or air motor, any of which may be removably attached to a plinth 104. Thus the torque applicator 100 may comprise or be combined with a motor for controlling a degree of torque applied by the torque applicator. The power sourced is operated to drive the polished rod 34 rotatably in a clockwise or counter-clockwise direction aiding in the installation and retrieval of a downhole threaded component, e.g., BPV and/or TWCV.

Thus, the torque applicator 100 may comprise or be connected to a gear box 102. In one example implementation the gearbox 100 may be connected to gear box 102 using at least one of the first clamp 50 and the second clamp 51. Although FIG. 10 shows torque applicator 100 connected for use with second clamp 51, the torque applicator 100 may alternative be connected to first clamp 50. Further, although the torque applicator 100 is shown in FIG. 10 as employed with an extensible actuator 52 which is situated in the yoke cavity 42, in the manner of FIG. 3, the torque applicator 100 may also be utilized in conjunction with an extensible actuator 52(8) which is situated external to yoke housing 40. In one example implementation, the gearbox 102 may be connected to a single clamp. In another example implementation, snap/lock rings may be used to mount the extensible actuator 52 to the yoke body, in which case it may be able to rotate around its axis. Thrust needle roller bearings may be employed to limit the friction between the rings and the bodies.

The extensible actuator 52 may take differing forms and structures, and have differing operations. A hydraulic type of extensible actuator has primarily been discussed above. As used herein, "hydraulic" encompasses, for example, use of fluids such as air, oil, water, etc.). Thus in some example embodiments and modes the extensible actuator comprises a hydraulic cylinder, and the controller is configured to selectively supply hydraulic pressure to the hydraulic cylinder, the first clamp, and the second clamp to provide the translation of the barrel rod along the axis of the yoke cavity.

The lubricator yoke 20 of the technology disclosed herein has distinct advantages and benefits when the extensible actuator is hydraulic, as compared to prior art hydraulic wellhead lubricators. According to the technology disclosed herein, the yoke controller 54 is configured to selectively supply a first measure of hydraulic pressure to the hydraulic cylinder to translate the barrel rod along a predetermined displacement less than an axial length of the yoke cavity, and by virtue of repeated applications of the first measure of hydraulic pressure the barrel rod is translated a greater displacement than the predetermined displacement without use of greater than the first measure of hydraulic pressure.

Figure 11:
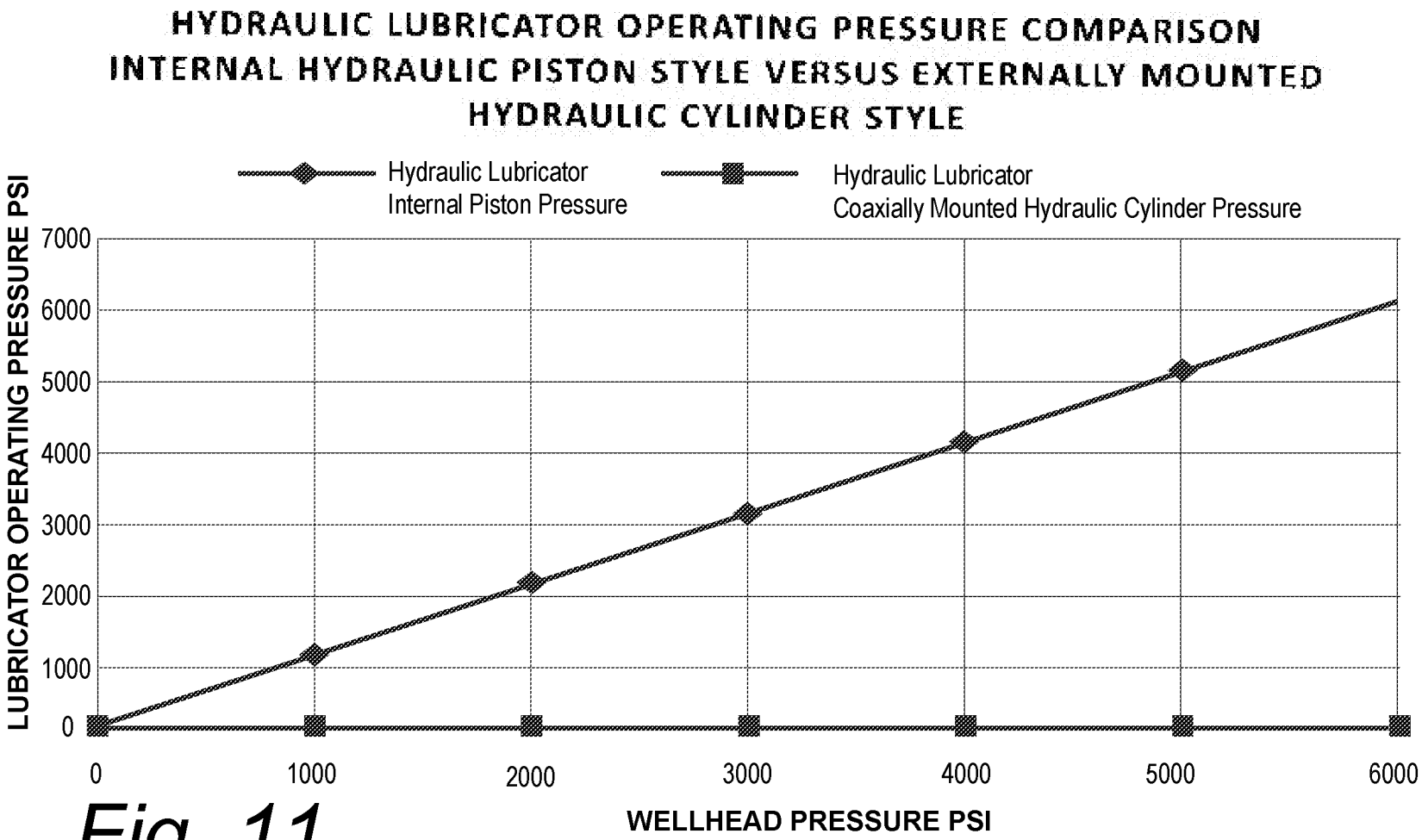
FIG. 11 is a graph which contrasts, at differing wellhead pressures, operating pressure experienced by a conventional wellhead lubricator and a wellhead lubricator of the example embodiment and mode of FIG. 3-FIG. 5.

FIG. 11 contrasts, at differing wellhead pressures, operating pressure experienced by a conventional wellhead lubricator, such as an internal piston lubricator of a type shown in US Patent Publication 2012/0024521 to Villa, and a wellhead lubricator of the example embodiment and mode of FIG. 3-FIG. 5. The operating pressure experienced by a wellhead lubricator of the internal piston type may be a function of piston diameter used. The starting point for the lubricator operating pressure is not zero due to the fact that each has to overcome the friction of the sealing elements located within the yoke assembly. The driving factor is the buckling capacity of the rod used. Most hydraulic lubricators of the internal piston type have 2" rods to transport the BPV in to the well. Other designs use a smaller rod but have a limit as to how far into the well they can go. The wellhead lubricator of the technology disclosed herein does not have any of the limitations of these other designs, and may use a small diameter rod (typically 1¼") and run it in to a wellhead with 15,000 psi without fear of buckling the rod due to pressure differential.

Other types of extensible actuators may be employed in other example embodiments and modes. For example, the extensible actuators described herein may be electrically or magnetically driven in order to cause the actuator piston 90 to reciprocate, e.g., extend and retract, in similar manner as described above in conjunction with the hydraulic embodiments. The extensible actuator 52 may comprise, for example, an electrically or magnetically actuated cylinder, e.g., piston. Such electrical and/or magnetic type extensible actuator 52 may utilize propulsion techniques and principles such as are employed in magnetic levitation transportation, e.g., trains.

Figure 12A:
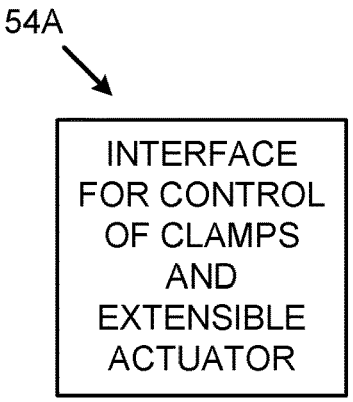
FIG. 12A, FIG. 12B, FIG. 12C, FIG. 12D, and FIG. 12E are diagrammatic views showing differing implementations or forms of a controller such as a yoke controller described in one or more of the example embodiments and modes.
Figure 12B:
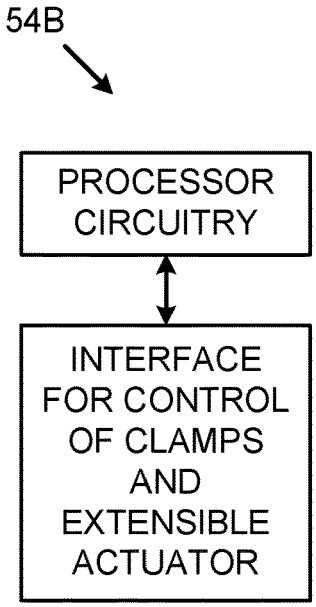
Figure 12C:
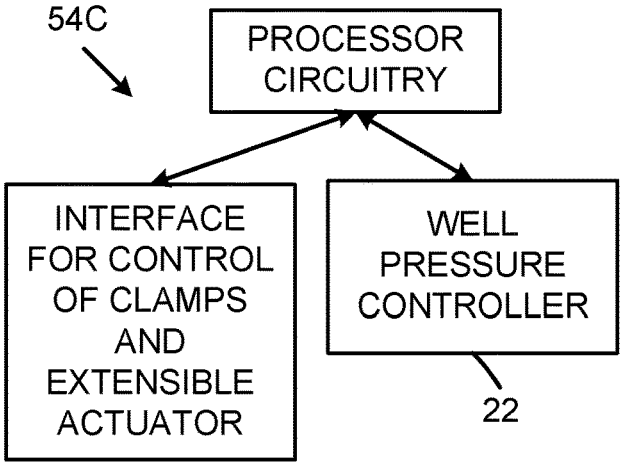
Figure 12D:
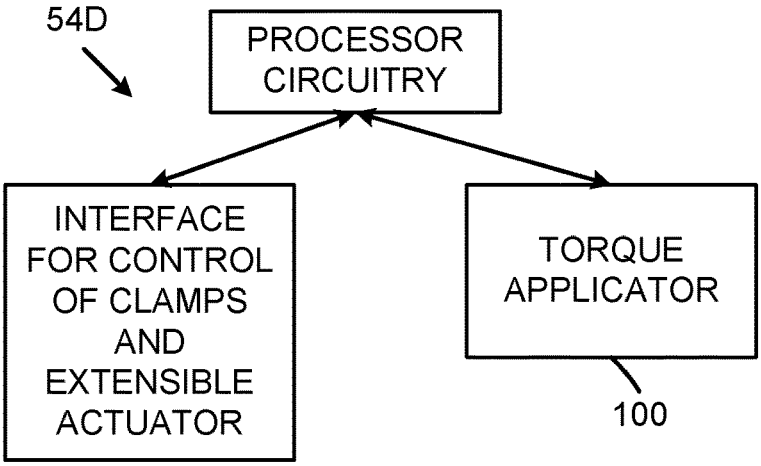
Figure 12E:
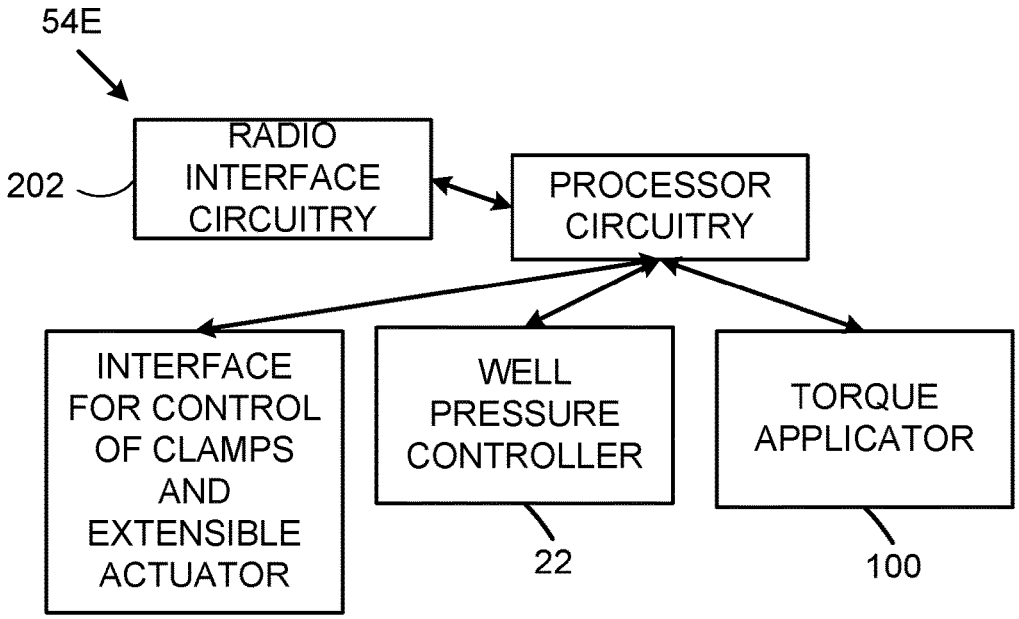

The technology disclosed herein may employ any suitable type of yoke controller. FIG. 12A, FIG. 12B, FIG. 12C, FIG. 12D, and FIG. 12E show differing example implementations or forms of a controller such as a yoke controller described in one or more of the example embodiments and modes of the technology disclosed herein. FIG. 12A shows that a yoke controller 54A make take the basis form of an interface connected to the first clamp 50, second clamp 51 and extensible actuator 52 which is actuated or governed to perform the acts described herein for coordinated operation to provide translation of the barrel rod along the axis of the yoke cavity. For example, the yoke controller 54A may comprise a panel of manually actuated levers operated by human sequencing. The interface of yoke controller 54A may be suited for whatever control medium utilized by lubricator yoke 20, e.g., hydraulic or electric, for example. Alternatively, FIG. 12B shows that yoke controller 54B may be partially or totally automated. Automation may be implemented, for example, when the yoke controller 54 comprises a state machine or processor circuitry, such as processor 88 shown in FIG. 4. FIG. 12C shows that, in an example non-limiting embodiment and mode, yoke controller 54C may include not only the interface for lubricator yoke 20, but also the well pressure controller 22, so that both are under common or coordinated control, for example. FIG. 12D shows that, in an example non-limiting embodiment and mode, yoke controller 54D may further or additionally control and/or include torque applicator 100. FIG. 12E shows that, in an example non-limiting embodiment and mode, yoke controller 54E may further be operable with or include radio interface circuitry 202 whereby yoke controller 54E may be remotely controlled by a remote device such as a laptop or cell phone with mobile termination, for example. It should be understood that selected aspects of one or more of FIG. 12A-FIG. 12E may be utilized in combination or differing combination than shown.

Figure 13:
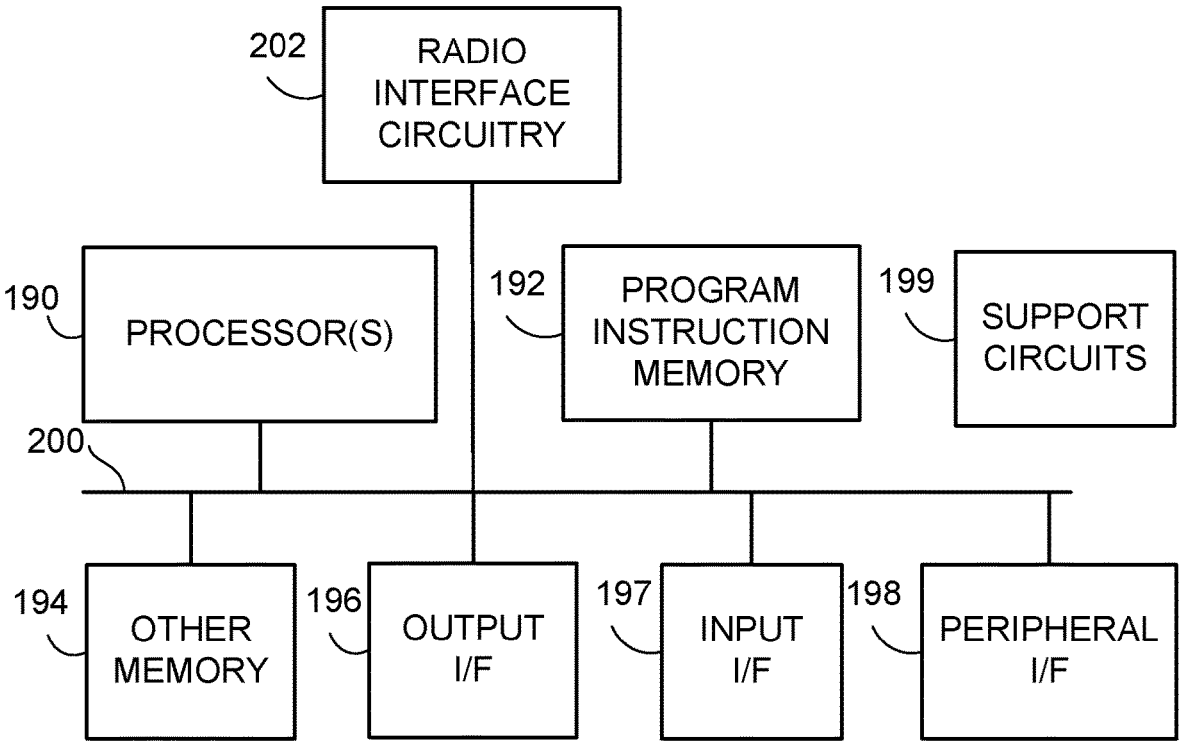
FIG. 13 is a diagrammatic view showing example elements comprising electronic machinery which may comprise a lubricator yoke.

An example of appropriate processor circuitry is shown in FIG. 13. Whether automated or manual, the yoke controller 54 may operate the lubricator yoke 20 either hydraulically or otherwise, e.g., electrically or magnetically, as described above in example fashion. In an example hydraulic implementation, the yoke controller 54 may comprise a series of valves which are operable to control selective supply of hydraulic fluid to the hydraulic cylinder, the first clamp, and the second clamp. The yoke controller 54 may also comprise processor circuitry which is configured to control the series of valves and thereby to control supply of hydraulic fluid to the hydraulic cylinder, the first clamp, and the second clamp.

FIG. 13 shows an example of electronic machinery, e.g., processor circuitry, which may comprise yoke controller 54 of lubricator yoke 20 in some example embodiments and modes. The electronic machinery comprises one or more processors 190, program instruction memory 192; other memory 194 (e.g., RAM, cache, etc.); input/output interfaces 196 and 197, peripheral interfaces 198; support circuits 199; and busses 200 for communication between the aforementioned units.

A memory may be one or more of readily available memory such as random access memory (RAM), read only memory (ROM), floppy disk, hard disk, flash memory or any other form of digital storage, local or remote, and is preferably of non-volatile nature, as and such may comprise memory. The support circuits 199 are coupled to the processors 190 for supporting the processor in a conventional manner. These circuits include cache, power supplies, clock circuits, input/output circuitry and subsystems, and the like.

Although the processes and methods of the disclosed embodiments may be discussed as being implemented as a software routine, some of the method steps that are disclosed therein may be performed in hardware as well as by a processor running software. As such, the embodiments may be implemented in software as executed upon a computer system, in hardware as an application specific integrated circuit or other type of hardware implementation, or a combination of software and hardware. The software routines of the disclosed embodiments are capable of being executed on any computer operating system, and is capable of being performed using any CPU architecture.

The functions of the various elements including functional blocks, including but not limited to those labeled or described as "computer", "processor" or "controller", may be provided through the use of hardware such as circuit hardware and/or hardware capable of executing software in the form of coded instructions stored on computer readable medium. Thus, such functions and illustrated functional blocks are to be understood as being either hardware-implemented and/or computer-implemented, and thus machine-implemented.

In terms of hardware implementation, the functional blocks may include or encompass, without limitation, digital signal processor (DSP) hardware, reduced instruction set processor, hardware (e.g., digital or analog) circuitry including but not limited to application specific integrated circuit(s) [ASIC], and/or field programmable gate array(s) (FPGA(s)), and (where appropriate) state machines capable of performing such functions.

Whether in a hydraulic context or electrical/magnetic, in example embodiments and modes wherein the yoke controller 54 comprises processor circuitry, the lubricator yoke 20 may further comprise radio interface circuitry 202 (see FIG. 13) for receiving wireless signals for operating the processor circuitry.

While various example aspects of the technology disclosed herein concern the lubricator yokes described herein, in other example embodiments and modes the technology disclosed herein covers and encompasses a combination of the lubricator yoke with other components, such as, by way of example, the barrel portion 30.

It should also be appreciated that various features of the technology disclosed herein may be utilized in combination with one another, although not specifically shown or discussed as such.

In view of the foregoing, a wellhead lubricator is provided by the technology disclosed herein which, among other advantages and features, eliminates the need to move the polished rod 34 up and down manually or with regulated hydraulic pressure applied to an internal piston attached to the polished rod that relies on monitoring the wellhead pressure to ensure the polished rod does not experience buckling during well maintenance. It also added an additional optional enhancement of rotatably installing or retrieving down-hole threaded components.

The technology disclosed herein provides, e.g., in at least some of its example non-limiting embodiments and modes, a tool for use at a wellhead such as an oil or natural gas well. The tool has a polished rod on which an item, such as a back pressure valve, may be disposed for placement, for example to isolate the wellhead from well pressure to permit servicing. The rod is gripped and moved externally by means of clamps and hydraulic cylinders. Under power and sequencing of a manifold and series of valves manually or by programmable means, enables the rod and any item attached to it to be moved in and out of the wellhead, with or without pressure in the well.

The technology disclosed herein provides, e.g., in at least some of its example non-limiting embodiments and modes, apparatus and method for the hydraulic operation of a lubricator to convey downhole tools into and out from a wellhead in order to perform servicing of components associated with the wellhead. For example, it may be desired to install in the well tubing, below the wellhead Christmas tree a back pressure valve (BPV). The BPV when installed contains the well pressure enabling release of pressure above it and the subsequent safe removal and or servicing of equipment installed on the wellhead.

The technology disclosed herein provides, e.g., in at least some of its example non-limiting embodiments and modes, a lubricator which is fitted with externally mounted hydraulic components that are coaxially placed about the polished rod. These hydraulic components enable the clamping and conveyance of the rod into and out of the wellhead in a safe and controlled manner. This is carried out all while the lubricator is completely pressure balanced. Eliminating the need for combustion engines, large hydraulic high pressure power packs, and sophisticated monitoring equipment to monitor the wellhead pressure.

The technology disclosed herein provides, e.g., in at least some of its example non-limiting embodiments and modes, a lubricator with BPV attached which is mounted atop the wellhead Christmas tree. Most commonly this is a type H BPV. However it could be a two way check valve (TWCV), Tubing Hanger, Frac Sleeve, or other component enabling additional servicing procedures to occur to the wellhead.

The technology disclosed herein provides, e.g., in at least some of its example non-limiting embodiments and modes, a polished rod which is clamped by a lower spring loaded device that maintains load on the polished rod at all times. This action allows the polished rod to remain locked in place, preventing it from moving prematurely into the wellhead under gravitational effects. The upper clamp device is integrated with a hydraulic cylinder. It is this combination of components that allows the controlled lowering of the BPV or other components into the wellhead.

The technology disclosed herein provides, e.g., in at least some of its example non-limiting embodiments and modes, a lubricator apparatus and method for use at a wellhead that can provide the advantages of both systems and eliminate the problems of both systems. The lubricator assembly has an upper section that comprises a high pressure tubular, sealing elements and a means of connecting to the lower section. The lower section comprises a high pressure tubular and sealing elements and means by which it can be connected to the wellhead Christmas tree or BOP. A polished rod is housed through the entire length of the upper and lower sections of the lubricator assembly. A manifold is mounted to the lubricator and connects the upper high pressure tubular with the lower high pressure tubular and when connected to the wellhead the lower section is exposed to wellhead pressure. Wellhead pressure, if any, is, by means of the manifold, routed through the lower section of the lubricator to the upper section of the lubricator thus putting the entire lubricator under the same pressure. The polished rod located within the lubricator is now pressure balanced and can be manipulated either manually or in this inventions case externally by hydraulic means Thus the scope of the technology disclosed herein should be determined by the appended claims and their legal equivalents. Therefore, it will be appreciated that the scope of the technology disclosed herein fully encompasses other embodiments which may become obvious to those skilled in the art, and that the scope of the technology disclosed herein is accordingly to be limited by nothing other than the appended claims, in which reference to an element in the singular is not intended to mean "one and only one" unless explicitly so stated, but rather "one or more." The above-described embodiments could be combined with one another. All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the technology disclosed herein, for it to be encompassed by the present claims. Furthermore, no element, component, or method step in the present disclosure is intended to be dedicated to the public regardless of whether the element, component, or method step is explicitly recited in the claims.

What is claimed is:

1. A wellhead lubricator comprising:

a yoke housing, the yoke housing comprising a first end configured for connection to a barrel housing and a second end configured for connection to a wellhead, the yoke housing defining a yoke cavity which is isolated from pressure from the wellhead and through which a barrel rod extends along an axis of the yoke cavity;

a first clamp situated in the yoke cavity and configured for selective engagement with the barrel rod;

a second clamp situated in the yoke cavity and configured for selective engagement with the barrel rod;

an extensible actuator connected to at least one of the first clamp and the second clamp;

a pressure controller configured to balance pressure from the wellhead above and below the yoke housing and the yoke cavity defined therein;

wherein the extensible actuator, the first clamp, and the second clamp are configured to be operated in coordinated manner to provide translation of the barrel rod along the axis of the yoke cavity.

2. The wellhead lubricator of claim 1, wherein the extensible actuator situated in the yoke cavity and co-axially mounted about the barrel rod.

3. The wellhead lubricator of claim 1, wherein the extensible actuator comprises a hydraulic cylinder.

4. The wellhead lubricator of claim 1 in combination with a barrel assembly, the barrel assembly comprising the barrel housing and the barrel rod.

5. The wellhead lubricator of claim 1, wherein the pressure controller comprises tubing routed around the yoke housing and valves for balancing wellhead pressure about the yoke housing.

6. A wellhead lubricator comprising:

a yoke housing, the yoke housing comprising a first end configured for connection to a barrel housing and a second end configured for connection to a wellhead, the yoke housing defining a yoke cavity through which a barrel rod extends along an axis of the yoke cavity, a first clamp situated in the yoke cavity and configured for selective engagement with the barrel rod;

a second clamp situated in the yoke cavity and configured for selective engagement with the barrel rod;

an extensible actuator connected to at least one of the first clamp and the second clamp;

a controller configured to actuate the extensible actuator, the selective engagement of the first clamp, and the selective engagement of the second clamp in the coordinated manner to provide the translation of the barrel rod along the axis of the yoke cavity.

7. The wellhead lubricator of claim 6, wherein the controller is manually operable to provide translation of the barrel rod along the axis of the yoke cavity.

8. The wellhead lubricator of claim 6, wherein the controller comprises a series of valves which are operable to control selective supply of hydraulic fluid to the hydraulic cylinder, the first clamp, and the second clamp.

9. The wellhead lubricator of claim 8, wherein the controller comprises processor circuitry which is configured to control the series of valves and thereby to control supply of hydraulic fluid to the hydraulic cylinder, the first clamp, and the second clamp.

10. The wellhead lubricator of claim 6, wherein the controller comprises processor circuitry configured to actuate the extensible actuator, the selective engagement of the first clamp, and the selective engagement of the second clamp.

11. The wellhead lubricator of claim 10, further comprising a radio interface circuitry for receiving wireless signals for operating the processor circuitry.

12. A wellhead lubricator comprising:

a yoke housing, the yoke housing comprising a first end configured for connection to a barrel housing and a second end configured for connection to a wellhead, the yoke housing defining a yoke cavity through which a barrel rod extends along an axis of the yoke cavity;

a first clamp situated in the yoke cavity and configured for selective engagement with the barrel rod;

a second clamp situated in the yoke cavity and configured for selective engagement with the barrel rod;

an extensible actuator connected to at least one of the first clamp and the second clamp;

wherein the extensible actuator, the first clamp, and the second clamp are configured to be operated in coordinated manner to provide translation of the barrel rod along the axis of the yoke cavity;

wherein the extensible actuator situated in the yoke cavity and co-axially mounted about the barrel rod;

wherein the extensible actuator is connected to the first clamp and is situated in the yoke cavity between the yoke housing first end and the first clamp; and wherein the second clamp is situated in the yoke cavity between the first clamp and the yoke housing second end.

13. A wellhead lubricator of comprising:

a yoke housing, the yoke housing comprising a first end configured for connection to a barrel housing and a second end configured for connection to a wellhead, the yoke housing defining a yoke cavity through which a barrel rod extends along an axis of the yoke cavity;

a first clamp situated in the yoke cavity and configured for selective engagement with the barrel rod;

a second clamp situated in the yoke cavity and configured for selective engagement with the barrel rod;

an extensible actuator connected to at least one of the first clamp and the second clamp;

wherein the extensible actuator, the first clamp, and the second clamp are configured to be operated in coordinated manner to provide translation of the barrel rod along the axis of the yoke cavity;

wherein the extensible actuator is connected to both the first clamp and the second clamp.

14. The wellhead lubricator of claim 13, wherein the extensible actuator is situated radially exterior to the yoke cavity along an actuator axis which is parallel to the axis of the yoke cavity, and wherein the extensible actuator is at least partially situated between a first connector which connects the extensible actuator to the first clamp and a second connector which connects the actuator element to the second clamp.

15. The wellhead lubricator of claim 14, wherein the first connector and the second connector extend through a yoke window provided in the yoke housing.

16. A wellhead lubricator comprising:

a yoke housing, the yoke housing comprising a first end configured for connection to a barrel housing and a second end configured for connection to a wellhead, the yoke housing defining a yoke cavity through which a barrel rod extends along an axis of the yoke cavity;

a first clamp situated in the yoke cavity and configured for selective engagement with the barrel rod;

a second clamp situated in the yoke cavity and configured for selective engagement with the barrel rod;

an extensible actuator connected to at least one of the first clamp and the second clamp;

wherein the extensible actuator, the first clamp, and the second clamp are configured to be operated in coordinated manner to provide translation of the barrel rod along the axis of the yoke cavity;

wherein the extensible actuator comprises a hydraulic cylinder; and further comprising a controller configured to actuate the extensible actuator, the selective engagement of the first clamp, and the selective engagement of the second clamp in the coordinated manner to provide the translation of the barrel rod along the axis of the yoke cavity, and wherein the controller is configured to selectively supply hydraulic pressure to the hydraulic cylinder, the first clamp, and the second clamp to provide the translation of the barrel rod along the axis of the yoke cavity.

17. The wellhead lubricator of claim 16, wherein the controller is configured to selectively supply a first measure of hydraulic pressure to the hydraulic cylinder to translate the barrel rod along a predetermined displacement less than an axial length of the yoke cavity, and by virtue of repeated applications of the first measure of hydraulic pressure the barrel rod is translated a greater displacement than the predetermined displacement without use of greater than the first measure of hydraulic pressure.

18. A wellhead lubricator comprising:

a yoke housing, the yoke housing comprising a first end configured for connection to a barrel housing and a second end configured for connection to a wellhead, the yoke housing defining a yoke cavity through which a barrel rod extends along an axis of the yoke cavity;

a first clamp situated in the yoke cavity and configured for selective engagement with the barrel rod;

a second clamp situated in the yoke cavity and configured for selective engagement with the barrel rod;

an extensible actuator connected to at least one of the first clamp and the second clamp;

wherein the extensible actuator, the first clamp, and the second clamp are configured to be operated in coordinated manner to provide translation of the barrel rod along the axis of the yoke cavity;

wherein the extensible actuator comprises a hydraulic cylinder; and wherein the controller comprises a hydraulic power unit.

19. A wellhead lubricator comprising:

a yoke housing, the yoke housing comprising a first end configured for connection to a barrel housing and a second end configured for connection to a wellhead, the yoke housing defining a yoke cavity through which a barrel rod extends along an axis of the yoke cavity;

a first clamp situated in the yoke cavity and configured for selective engagement with the barrel rod;

a second clamp situated in the yoke cavity and configured for selective engagement with the barrel rod;

an extensible actuator connected to at least one of the first clamp and the second clamp;

wherein the extensible actuator, the first clamp, and the second clamp are configured to be operated in coordinated manner to provide translation of the barrel rod along the axis of the yoke cavity;

wherein the extensible actuator comprises an electrically or magnetically actuated cylinder.

20. A wellhead lubricator comprising:

a yoke housing, the yoke housing comprising a first end configured for connection to a barrel housing and a second end configured for connection to a wellhead, the yoke housing defining a yoke cavity through which a barrel rod extends along an axis of the yoke cavity;

a first clamp situated in the yoke cavity and configured for selective engagement with the barrel rod;

a second clamp situated in the yoke cavity and configured for selective engagement with the barrel rod;

an extensible actuator connected to at least one of the first clamp and the second clamp;

wherein the extensible actuator, the first clamp, and the second clamp are configured to be operated in coordinated manner to provide translation of the barrel rod along the axis of the yoke cavity;

further comprising a torque applicator which is connected to at least one of the first clamp and the second clamp and configured to rotate the barrel rod about the axis of the yoke cavity.

21. The wellhead lubricator of claim 20, wherein the torque applicator includes a gear box connected to the at least one of the first clamp and the second clamp.

22. The wellhead lubricator of claim 20, further comprising a motor for controlling a degree of torque applied by the torque applicator.

23. A method of operating a wellhead lubricator comprising:

isolating a yoke cavity from pressure from a wellhead, a barrel rod extending along an axis of the yoke cavity, the yoke cavity being provided in a yoke housing which comprises a first end configured for connection to a barrel housing and a second end configured for connection to the wellhead;

balancing wellhead pressure above and below the yoke cavity;

operating, in coordinated manner to provide translation of a barrel rod along an axis of the yoke cavity:

a first clamp situated in the yoke cavity and configured for selective engagement with the barrel rod;

a second clamp situated in the yoke cavity and configured for selective engagement with the barrel rod;

an extensible actuator connected to at least one of the first clamp and the second clamp.

24. A wellhead lubricator apparatus comprising:

a yoke assembly configured to engage a wellhead and comprising a yoke cavity which is isolated from pressure from the wellhead;

a barrel assembly configured to be detachably engageable with the yoke assembly, the barrel assembly comprising:

a barrel housing into which pressure from the wellhead travels;

a rod movable coaxially within the barrel housing and having a tool attached to a lower portion of the rod, the rod extending through the yoke assembly, the rod being subject to the pressure from the wellhead in the barrel housing but not subject to the pressure from the wellhead in the yoke cavity;

a pressure controller configured to balance pressure from the wellhead above and below the yoke cavity; and an actuator situated in the yoke assembly for controllably moving rod reciprocally.

25. The wellhead lubricator of claim 24, further comprising:

a hydraulic cylinder coaxially mounted around the rod and removably mounted to the yoke assembly;

a first clamp assembly coaxially mounted around the rod, within the yoke cavity, and removably mounted to the hydraulic cylinder; and a second clamp assembly coaxially mounted around the rod, within the yoke cavity, and removably mounted to a lower portion of the yoke assembly;

hydraulic means for controllably moving the hydraulic piston, clamp assembly and polished rod reciprocally.

* * * * *